US008898855B2

(12) United States Patent
Sunderland

(10) Patent No.: US 8,898,855 B2
(45) Date of Patent: Dec. 2, 2014

(54) CLEANING APPLIANCE

(75) Inventor: David Robert Sunderland, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 436 days.

(21) Appl. No.: 13/248,824

(22) Filed: Sep. 29, 2011

(65) Prior Publication Data

US 2012/0079676 A1 Apr. 5, 2012

(30) Foreign Application Priority Data

Sep. 30, 2010 (GB) ..... 1016453.1

(51) Int. Cl.
*A47L 5/00* (2006.01)
*A47L 9/00* (2006.01)

(52) U.S. Cl.
CPC ..... *A47L 9/009* (2013.01)
USPC ..... 15/327.2; 15/327.4

(58) Field of Classification Search
USPC ..... 15/327.2, 327.4, 327.6, 327.7, 328, 15/329, 337, 350, 352, 353, 410, 411; 55/429, 493, DIG. 3
See application file for complete search history.

(56) References Cited

U.S. PATENT DOCUMENTS

| | | | |
|---|---|---|---|
| 963,139 | A | 7/1910 | Griffiths |
| 1,123,839 | A | 1/1915 | Bridges |
| 1,301,453 | A | 4/1919 | Kendall |
| 1,605,507 | A | 11/1926 | Burke |
| 1,861,402 | A | 5/1932 | Riper |
| 1,918,713 | A | 7/1933 | Ponselle |
| 2,125,850 | A | 8/1938 | Norris |
| RE22,426 | E | 1/1944 | Smellie |
| 2,352,504 | A | 6/1944 | White |
| 2,489,100 | A | 11/1949 | Marco |
| 2,686,330 | A | 8/1954 | Wales |
| 2,699,838 | A | 1/1955 | Holm-Hansen |
| 2,738,538 | A | 3/1956 | Vance |
| 2,747,216 | A | 5/1956 | Tschudy |
| 2,771,309 | A | 11/1956 | Clark, Jr. |
| 2,834,605 | A | 5/1958 | McCollough |
| 2,876,479 | A | 3/1959 | Kaufman |
| 2,954,802 | A | 10/1960 | Duff |
| 3,038,743 | A | 6/1962 | Zaloumis |
| 3,375,541 | A | 4/1968 | Fromknecht |

(Continued)

FOREIGN PATENT DOCUMENTS

| | | |
|---|---|---|
| CN | 1050981 | 5/1991 |
| CN | 1310979 | 9/2001 |

(Continued)

OTHER PUBLICATIONS

Sunderland et al., U.S. Office Action mailed Jun. 20, 2013, directed to U.S. Appl. No. 12/729,643; 7 pages.

(Continued)

*Primary Examiner* — Dung Van Nguyen
(74) *Attorney, Agent, or Firm* — Morrison & Foerster LLP

(57) ABSTRACT

A cleaning appliance includes a substantially spherical surface engaging rolling assembly having a fluid inlet for receiving a fluid flow and a system for drawing the fluid flow through the inlet, and a plurality of support members for supporting the rolling assembly as it is maneuvered over a surface. The center of gravity of the cleaning appliance is located within the rolling assembly.

16 Claims, 11 Drawing Sheets

(56) References Cited

U.S. PATENT DOCUMENTS

| | | | | |
|---|---|---|---|---|
| 3,378,877 | A | 4/1968 | Boerrefors | |
| 3,524,211 | A | 8/1970 | Wolf | |
| 3,524,212 | A | 8/1970 | Spencer | |
| 3,608,333 | A | 9/1971 | Selley et al. | |
| 4,059,296 | A | 11/1977 | Panourgias | |
| 4,486,037 | A | 12/1984 | Shotbolt | |
| 4,573,236 | A | 3/1986 | Dyson | |
| 5,134,749 | A | 8/1992 | Sakurai et al. | |
| 5,144,716 | A * | 9/1992 | Watanabe et al. | 15/323 |
| 5,149,147 | A | 9/1992 | Kastrup et al. | |
| 5,275,444 | A | 1/1994 | Wythoff | |
| 5,353,470 | A | 10/1994 | Bartlett | |
| 5,467,500 | A | 11/1995 | O'Hara et al. | |
| 5,784,757 | A | 7/1998 | Cipolla | |
| 5,815,881 | A * | 10/1998 | Sjogreen | 15/321 |
| 5,839,156 | A | 11/1998 | Park et al. | |
| 5,937,477 | A | 8/1999 | Dyson | |
| 5,954,370 | A | 9/1999 | Pietersen | |
| 6,058,559 | A | 5/2000 | Yoshimi et al. | |
| 6,079,690 | A | 6/2000 | Yoon | |
| 6,141,822 | A | 11/2000 | Riviera-Boklund et al. | |
| 6,154,921 | A * | 12/2000 | Green et al. | 15/410 |
| 6,158,781 | A | 12/2000 | Aaron, III | |
| 6,317,921 | B1 | 11/2001 | Park et al. | |
| 6,345,408 | B1 * | 2/2002 | Nagai et al. | 15/361 |
| 6,371,421 | B1 | 4/2002 | Ma et al. | |
| 6,474,696 | B1 | 11/2002 | Canale | |
| 6,482,246 | B1 | 11/2002 | Dyson et al. | |
| 6,484,350 | B2 | 11/2002 | Yung | |
| 6,536,073 | B2 | 3/2003 | Uratani et al. | |
| 6,712,868 | B2 * | 3/2004 | Murphy et al. | 55/330 |
| 6,928,690 | B2 | 8/2005 | Ji | |
| 7,185,389 | B2 | 3/2007 | Thomason et al. | |
| 7,380,308 | B2 * | 6/2008 | Oh et al. | 15/327.2 |
| D591,016 | S | 4/2009 | Dyson et al. | |
| 8,020,251 | B2 | 9/2011 | Luebbering et al. | |
| 8,079,113 | B2 | 12/2011 | Chong et al. | |
| 8,117,713 | B2 * | 2/2012 | Kasper et al. | 15/353 |
| 8,359,705 | B2 * | 1/2013 | Conrad | 15/329 |
| 2001/0029641 | A1 | 10/2001 | Uratani et al. | |
| 2002/0063427 | A1 | 5/2002 | Schiemann et al. | |
| 2004/0045121 | A1 | 3/2004 | Kim | |
| 2005/0039297 | A1 | 2/2005 | Morgan et al. | |
| 2005/0066635 | A1 | 3/2005 | Genn et al. | |
| 2005/0108849 | A1 | 5/2005 | Lam | |
| 2005/0198764 | A1 | 9/2005 | Heatley | |
| 2005/0223517 | A1 | 10/2005 | Courtney | |
| 2005/0235454 | A1 | 10/2005 | Courtney | |
| 2006/0101610 | A1 | 5/2006 | Oh et al. | |
| 2006/0131876 | A1 | 6/2006 | Knowles et al. | |
| 2006/0213023 | A1 | 9/2006 | Hare et al. | |
| 2007/0039118 | A1 | 2/2007 | Choi | |
| 2007/0067945 | A1 * | 3/2007 | Kasper et al. | 15/353 |
| 2007/0094840 | A1 | 5/2007 | Zahuranec et al. | |
| 2008/0196196 | A1 | 8/2008 | Conrad | |
| 2008/0263814 | A1 | 10/2008 | Bassett et al. | |
| 2008/0282497 | A1 | 11/2008 | Griffith et al. | |
| 2009/0007370 | A1 | 1/2009 | Gomiciaga-Pereda et al. | |
| 2009/0144928 | A1 | 6/2009 | Yoo | |
| 2010/0242208 | A1 | 9/2010 | Gammack et al. | |
| 2010/0242211 | A1 | 9/2010 | Sunderland et al. | |
| 2010/0242212 | A1 | 9/2010 | Dyson et al. | |
| 2010/0242213 | A1 | 9/2010 | Sunderland et al. | |
| 2010/0242214 | A1 | 9/2010 | Sunderland et al. | |
| 2010/0242215 | A1 | 9/2010 | Dyson et al. | |
| 2010/0242216 | A1 | 9/2010 | MacNaughton | |
| 2010/0242217 | A1 | 9/2010 | Sunderland et al. | |
| 2010/0242218 | A1 | 9/2010 | Genn et al. | |
| 2010/0242219 | A1 | 9/2010 | Dyson et al. | |
| 2010/0242220 | A1 | 9/2010 | Dyson et al. | |
| 2011/0088196 | A1 | 4/2011 | Wills et al. | |
| 2012/0079673 | A1 | 4/2012 | Wishney et al. | |
| 2012/0079674 | A1 | 4/2012 | Dyson et al. | |
| 2012/0079677 | A1 | 4/2012 | Dyson et al. | |
| 2014/0068890 | A1 | 3/2014 | Dyson et al. | |
| 2014/0075715 | A1 | 3/2014 | MacNaughton | |

FOREIGN PATENT DOCUMENTS

| | | |
|---|---|---|
| CN | 1337204 | 2/2002 |
| CN | 1428122 | 7/2003 |
| CN | 1593322 | 3/2005 |
| CN | 2764289 | 3/2006 |
| CN | 1794941 | 6/2006 |
| CN | 101262807 | 9/2008 |
| DE | 299 13 775 | 2/2000 |
| DE | 10 2006 008556 | 8/2007 |
| EP | 0 558 101 | 9/1993 |
| EP | 0558101 | 9/1993 |
| EP | 0734678 | 10/1996 |
| EP | 1 129 657 | 9/2001 |
| EP | 1 210 899 | 6/2002 |
| EP | 1 457 150 | 9/2004 |
| EP | 1493373 | 1/2005 |
| EP | 1474026 | 11/2005 |
| EP | 1669015 | 6/2006 |
| EP | 1836941 | 9/2007 |
| EP | 1 857 032 | 11/2007 |
| EP | 1915937 | 4/2008 |
| FR | 1.310.618 | 11/1962 |
| FR | 2833826 | 6/2003 |
| GB | 645847 | 11/1950 |
| GB | 2290462 | 1/1996 |
| GB | 2368516 | 5/2002 |
| GB | 2 391 459 | 2/2004 |
| GB | 2 407 022 | 4/2005 |
| GB | 2 402 046 | 9/2006 |
| GB | 2 433 425 | 6/2007 |
| GB | 2 452 549 | 3/2009 |
| GB | 2453995 | 4/2009 |
| GB | 2469038 | 10/2010 |
| GB | 2469039 | 10/2010 |
| GB | 2469045 | 10/2010 |
| GB | 2469046 | 10/2010 |
| GB | 2469047 | 10/2010 |
| GB | 2469052 | 10/2010 |
| GB | 2469055 | 10/2010 |
| GB | 2475765 | 6/2011 |
| GB | 2484121 | 4/2012 |
| JP | 2-107218 | 4/1990 |
| JP | 3-30 | 1/1991 |
| JP | 4-103851 | 9/1992 |
| JP | 5-91956 | 4/1993 |
| JP | 5-168577 | 7/1993 |
| JP | 7-163489 | 6/1995 |
| JP | 7-184809 | 7/1995 |
| JP | 8-275909 | 10/1996 |
| JP | 8-317883 | 12/1996 |
| JP | 9-276189 | 10/1997 |
| JP | 10-278835 | 10/1998 |
| JP | 2001-504001 | 3/2001 |
| JP | 2001-314356 | 11/2001 |
| JP | 2002-528250 | 9/2002 |
| JP | 2002-345693 | 12/2002 |
| JP | 2002-355199 | 12/2002 |
| JP | 2003-24249 | 1/2003 |
| JP | 2003-211025 | 7/2003 |
| JP | 2003-310491 | 11/2003 |
| JP | 2003-325392 | 11/2003 |
| JP | 2004-310385 | 11/2004 |
| JP | 2005-516712 | 6/2005 |
| JP | 2005-334450 | 12/2005 |
| JP | 2006-524062 | 10/2006 |
| JP | 2006-326186 | 12/2006 |
| JP | 2007-520294 | 7/2007 |
| JP | 2007-307352 | 11/2007 |
| JP | 2009-22403 | 2/2009 |
| JP | 2009-50735 | 3/2009 |
| NL | 6711520 | 2/1969 |
| WO | WO-00/24519 | 5/2000 |
| WO | WO-01/56449 | 8/2001 |
| WO | WO-03/034888 | 5/2003 |

(56) References Cited

FOREIGN PATENT DOCUMENTS

| | | |
|---|---|---|
| WO | WO-03/039316 | 5/2003 |
| WO | WO-03/068042 | 8/2003 |
| WO | WO-2008/090490 | 7/2008 |
| WO | WO-2008/117945 | 10/2008 |
| WO | WO-2009/011482 | 1/2009 |
| WO | WO-2009/022759 | 2/2009 |
| WO | WO-2009/030885 | 3/2009 |
| WO | WO-2010/112887 | 10/2010 |
| WO | WO-2011/072388 | 6/2011 |

OTHER PUBLICATIONS

MacNaughton, U.S. Office Action mailed Jun. 19, 2013, directed to U.S. Appl. No. 12/730,539; 11 pages.
Dyson et al., U.S. Office Action mailed Sep. 6, 2012, directed to U.S. Appl. No. 12/730,428; 12 pages.
Dyson et al., U.S. Office Action mailed Aug. 8, 2012, directed to U.S. Appl. No. 12/731,967; 14 pages.
Sunderland et al., U.S. Office Action mailed Aug. 24, 2012, directed to U.S. Appl. No. 12/729,849; 18 pages.
Sunderland et al., U.S. Office Action mailed Sep. 13, 2012, directed to U.S. Appl. No. 12/729,643; 11 pages.
MacNaughton, Roy, U.S. Office Action mailed Sep. 13, 2012, directed to U.S. Appl. No. 12/730,539; 9 pages.
Genn et al., U.S. Office Action mailed Sep. 13, 2012, directed to U.S. Appl. No. 12/730,900; 12 pages.
GB Search Report dated Jan. 24, 2011, directed to GB Application No. 1016453.1; 2 pages.
Genn et al., U.S. Office Action mailed Jul. 30, 2013, directed to U.S. Appl. No. 12/730,900; 5 pages.
Dyson et al., U.S. Office Action mailed Aug. 15, 2013, directed to U.S. Appl. No. 13/250,298; 12 pages.
Dyson et al., U.S. Office Action mailed Aug. 15, 2013, directed to U.S. Appl. No. 13/248,810 10 pages.
Dyson et al., U.S. Office Action mailed Sep. 11, 2013, directed to U.S. Appl. No. 12/729,751; 16 pages.
Wishney et al., U.S. Office Action mailed Oct. 1, 2013, directed to U.S. Appl. No. 13/248,808; 19 pages.
International Search Report and Written Opinion mailed on Nov. 25, 2011, directed to International Application No. PCT/GB2011/051654; 14 pages.
Dyson et al., U.S. Office Action mailed Sep. 21, 2012, directed to U.S. Appl. No. 12/730,913; 13 pages.
Dyson et al., U.S. Office Action mailed Sep. 27, 2012, directed to U.S. Appl. No. 12/729,751; 19 pages.
Sunderland et al., U.S. Office Action mailed Sep. 27, 2012, directed to U.S. Appl. No. 12/729,885; 20 pages.
Gammack et al., U.S. Office Action mailed Dec. 7, 2012, directed to U.S. Appl. No. 12/731,755; 11 pages.
Dyson et al., U.S. Office Action mailed Jan. 28, 2013, directed to U.S. Appl. No. 12/731,967; 14 pages.
Gammack et al., U.S. Office Action mailed Mar. 14, 2013, directed to U.S. Appl. No. 13/731,755; 9 pages.
Sunderland et al., U.S. Office Action mailed Feb. 12, 2013, directed to U.S. Appl. No. 12/729,643; 8 pages.
MacNaughton, Roy, U.S. Office Action mailed Feb. 14, 2013, directed to U.S. Appl. No. 12/730,539; 9 pages.
Dyson et al., U.S. Office Action mailed Jun. 10, 2013, directed to U.S. Appl. No. 12/730,428; 7 pages.
Dyson et al., U.S. Office Action mailed Apr. 8, 2013, directed to U.S. Appl. No. 12/729,751; 20 pages.
Sunderland et al., U.S. Office Action mailed Apr. 3, 2013, directed to U.S. Appl. No. 12/729,885; 10 pages.
Sunderland et al., U.S. Office Action mailed Apr. 12, 2013, directed to U.S. Appl. No. 12/730,890; 9 pages.
Wishney et al., U.S. Office Action mailed May 10, 2013, directed to U.S. Appl. No. 13/248,808; 21 pages.
Dyson et al, U.S. Office Action mailed Apr. 24, 2012, directed to U.S. Appl. No. 12/731,967; 19 pages.
Sunderland et al., U.S. Office Action mailed Apr. 25, 2012, directed to U.S. Appl. No. 12/729,849; 22 pages.
Dyson et al., U.S. Office Action mailed Jan. 2, 2013, directed to U.S. Appl. No. 12/730,428; 11 pages.
Genn et al., U.S. Office Action mailed Jan. 15, 2013, directed to U.S. Appl. No. 12/730,900; 8 pages.
Sunderland et al., U.S. Office Action mailed Dec. 24, 2012, directed to U.S. Appl. No. 12/730,890; 12 pages.
Dyson et al., U.S. Office Action mailed Mar. 21, 2014, directed to U.S. Appl. No. 13/250,298; 10 pages.
Dyson et al., U.S. Office Action mailed Mar. 26, 2014, directed to U.S. Appl. No. 13/248,810 11 pages.
Wishney et al., U.S. Office Action mailed Apr. 11, 2014, directed to U.S. Appl. No. 13/248,808; 23 pages.
Dyson et al., U.S. Office Action mailed Dec. 23, 2013, directed to U.S. Appl. No. 14/081,652; 7 pages.

* cited by examiner

CLEANING APPLIANCE

REFERENCE TO RELATED APPLICATIONS

This application claims the priority of United Kingdom Application No. 1016453.1, dated Sep. 30, 2010, the entire contents of which are incorporated herein by reference.

FIELD OF THE INVENTION

The present invention relates to a cleaning appliance, which is preferably in the form of a vacuum cleaning appliance.

BACKGROUND OF THE INVENTION

Cleaning appliances such as vacuum cleaners are well known. The majority of vacuum cleaners are either of the "upright" type or of the "cylinder" type (called canister or barrel machines in some countries). Cylinder vacuum cleaners generally comprise a main body which contains a motor-driven fan unit for drawing a dirt-bearing air flow into the vacuum cleaner, and separating apparatus, such as a cyclonic separator or a bag, for separating dirt and dust from the air flow. The dirt-bearing air flow is introduced to the main body through a suction hose and wand assembly which is connected to the main body. The main body of the vacuum cleaner is dragged along by the hose as a user moves around a room. A cleaning tool is attached to the remote end of the hose and wand assembly.

For example, GB 2,407,022 describes a cylinder vacuum cleaner having a chassis which supports cyclonic separating apparatus. The vacuum cleaner has two main wheels, one on each side of a rear portion of the chassis, and a castor wheel located beneath the front portion of the chassis which allow the vacuum cleaner to be dragged across a surface. Such a castor wheel tends be mounted on a circular support which is, in turn, rotatably mounted on the chassis to allow the castor wheel to swivel in response to a change in the direction in which the vacuum cleaner is dragged over the surface.

EP 1,129,657 describes a cylinder vacuum cleaner which is in the form of a spherical body connected to the suction hose and wand assembly. The spherical volume of the spherical body incorporates a pair of wheels, one located on each side of the body, and houses an electric blower for drawing a fluid flow through the cleaner, and a dust bag for separating dirt and dust from the fluid flow.

PCT/GB2010/050418 describes a cylinder vacuum cleaner having a generally spherical rolling assembly connected to the chassis for improving the maneuverability of the vacuum cleaner over a floor surface. The rolling assembly comprises a body and a pair of dome shaped wheels connected to the body. The chassis extends forwardly from the body of the rolling assembly, and includes a pair of wheels for steering the vacuum cleaner and for supporting the rolling assembly as the vacuum cleaner is maneuvered over a floor surface.

The chassis also includes a support for supporting cyclonic separating apparatus of the vacuum cleaner. The support is located on an inlet duct for conveying a dirt-bearing air flow to the separating apparatus. To assist with the maneuvering of the vacuum cleaner around objects located on the floor surface, the inlet duct is pivotably connected to the chassis for movement relative to the chassis as the user pulls the vacuum cleaner in different directions over the floor surface. The movement of the duct relative to the chassis actuates a steering mechanism for turning the wheels connected to the chassis. The inlet duct comprises a relatively rigid section connected to the chassis for pivoting movement relative thereto, and a relatively flexible hose located upstream to the rigid section and which tends to flex relative to the rigid section as the duct pivots relative to the chassis.

SUMMARY OF THE INVENTION

In a first aspect the present invention provides a cleaning appliance comprising a substantially spherical surface engaging rolling assembly comprising a fluid inlet for receiving a fluid flow and a system for drawing the fluid flow through the inlet, and a plurality of support members for supporting the rolling assembly as it is maneuvered over a surface, and wherein the center of gravity of the cleaning appliance is located within the rolling assembly.

The rolling assembly may comprise a substantially spherical casing which rotates as the cleaning appliance is moved over a floor surface. However, the appliance preferably comprises a main body and a plurality of surface engaging rolling elements rotatably connected to the main body, and which together define a substantially spherical rolling assembly.

In a second aspect the present invention provides a cleaning appliance comprising a main body comprising a fluid inlet for receiving a fluid flow, a system for drawing the fluid flow through the inlet, and a plurality of rolling elements rotatable relative to the main body and which define with the main body a substantially spherical surface engaging rolling assembly, and a plurality of support members for supporting the rolling assembly as it is maneuvered over a surface, and wherein the center of gravity of the cleaning appliance is located within the rolling assembly.

When the cleaning appliance is located on a substantially horizontal surface, the center of gravity of the cleaning appliance is preferably located in a first vertical plane which passes between, preferably generally midway between, a second vertical plane containing the points of contact between the rolling elements and the surface, and a third vertical plane containing the points of contact between the support members and the surface The system for drawing the fluid flow through the fluid inlet is preferably connected to the main body so that it does not rotate as the cleaning appliance is moved over the surface. The system for drawing the fluid flow through the fluid inlet preferably comprises a motor driven fan unit. The rolling assembly may comprise a filter for removing particulates from the fluid flow. The filter preferably extends at least partially about the motor, and is preferably removable from the main body. For example, the filter may be accessed by removing part of the outer casing of the main body of the rolling assembly, or by disconnecting one of the rolling elements of the rolling assembly from the main body.

As used herein, the term "a substantially spherical surface engaging rolling assembly" includes a spheroidal surface engaging rolling assembly. Each of the plurality of rolling elements is preferably in the form of a wheel rotatably connected to a respective side of the main body of the rolling assembly. Each of these rolling elements preferably has a curved, preferably dome-shaped, outer surface, and preferably has a rim which is substantially flush with the respective adjoining portion of the main body of the rolling assembly so that the rolling assembly may have a relatively continuous outer surface which can improve maneuverability of the appliance.

The rotational axes of the rolling elements may be inclined upwardly towards the main body with respect to a floor surface upon which the cleaning appliance is located so that the rims of the rolling elements engage the floor surface. The angle of the inclination of the rotational axes is preferably in the range from 4 to 15°, more preferably in the range from 5 to 10°. Each of the rolling elements preferably has an outer surface with substantially spherical curvature, and is preferably substantially hemispherical.

As a result of the inclination of the rotational axes of the rolling elements, part of the outer surface of the main body is exposed to enable components of the cleaning appliance, such as user-operable switches for activating the motor or a cable-rewind mechanism, to be located on the exposed part of the main body. In the preferred embodiment, one or more ports for exhausting the fluid flow from the cleaning appliance are located on the outer surface of the main body.

The appliance preferably comprises separating apparatus for separating dirt from the fluid flow. The separating apparatus is preferably located outside the rolling assembly, more preferably in front of the rolling assembly. The cleaning appliance preferably comprises a duct extending from the separating apparatus to the rolling assembly for conveying the fluid flow to the rolling assembly. The duct is preferably detachable from the separating apparatus to allow the separating apparatus to be removed from the appliance. To facilitate the detachment of the duct from the separating apparatus, the duct is preferably pivotably connected to the rolling assembly. The duct is preferably connected to the upper surface of the rolling assembly so that it can be moved between a raised position to allow the separating apparatus to be removed from, and subsequently relocated on, the appliance, and a lowered position, in which the duct is connected to the separating apparatus. In its lowered position, the duct is preferably configured to retain the separating apparatus on the appliance. The duct is preferably formed from a rigid material, preferably a plastics material, and may include a handle. The appliance is preferably configured to releasably retain the duct in the lowered position. This can inhibit accidental detachment of the duct from the separating apparatus during use of the appliance, and also allows the appliance to be carried using the handle connected to the duct.

The separating apparatus is preferably in the form of a cyclonic separating apparatus having at least one cyclone, and which preferably comprises a chamber for collecting dirt separated from the fluid flow. Other forms of separator or separating apparatus can be used and examples of suitable separator technology include a centrifugal separator, a filter bag, a porous container, an electrostatic separator or a liquid-based separator.

The appliance preferably comprises a support for supporting the base of the separating apparatus. The support is preferably integral with the main body of the rolling assembly. The main body may be formed from a plurality of sections, in which case the support is preferably integral with one of those sections. When it is located on the appliance the longitudinal axis of the separating apparatus, about which the wall of the separating apparatus extends, is preferably inclined at an acute angle to the vertical when the appliance moves along a substantially horizontal surface. This angle is preferably in the range from 30 to 70°.

The appliance preferably comprises an inlet duct for conveying the dirt-bearing fluid flow to the separating apparatus. The duct preferably passes beneath the support, and preferably passes through a sleeve located between the support and the main body of the rolling assembly. The sleeve is preferably integral with the support and the main body. Alternatively, the support may be connected to a chassis connected to the main body of the rolling assembly.

The distance between the points of contacts of the rolling elements of the rolling assembly with a surface is preferably shorter that the distance between the points of contacts of the support members with the surface. Preferably, the distance between the points of contact of the support members with a surface is at least 1.5 times the distance between the points of contacts of the rolling elements of the rolling assembly with the surface.

Each of the support members is preferably moveable relative to the rolling assembly to guide the movement of the appliance over the floor surface. Each of the support members preferably comprises a wheel or other rolling member, such as a caster or ball. The appliance preferably comprises a chassis connected to the rolling assembly, preferably to the main body of the rolling assembly, and each support member is preferably connected to this chassis. The chassis preferably comprises a body connected to the rolling assembly and a pair of side portions connected to, or integral with, the body of the chassis. Each of the support members is preferably located behind one of the side portions of the chassis so that the chassis can shield the support members from impact with walls, furniture or other items upstanding from the floor surface.

The cleaning appliance is preferably of the cylinder, or canister type.

Features described above in connection with the first aspect of the invention are equally applicable to the second aspect of the invention, and vice versa.

Although an embodiment of the invention is described in detail with reference to a vacuum cleaner, it will be appreciated that the invention can also be applied to other foams of cleaning appliance.

BRIEF DESCRIPTION OF THE DRAWINGS

Preferred features of the invention will now be described, by way of example only, with reference to the accompanying drawings, in which:

FIG. 5(*b*) is a top view of the same;

DETAILED DESCRIPTION OF THE INVENTION

Figure 1:
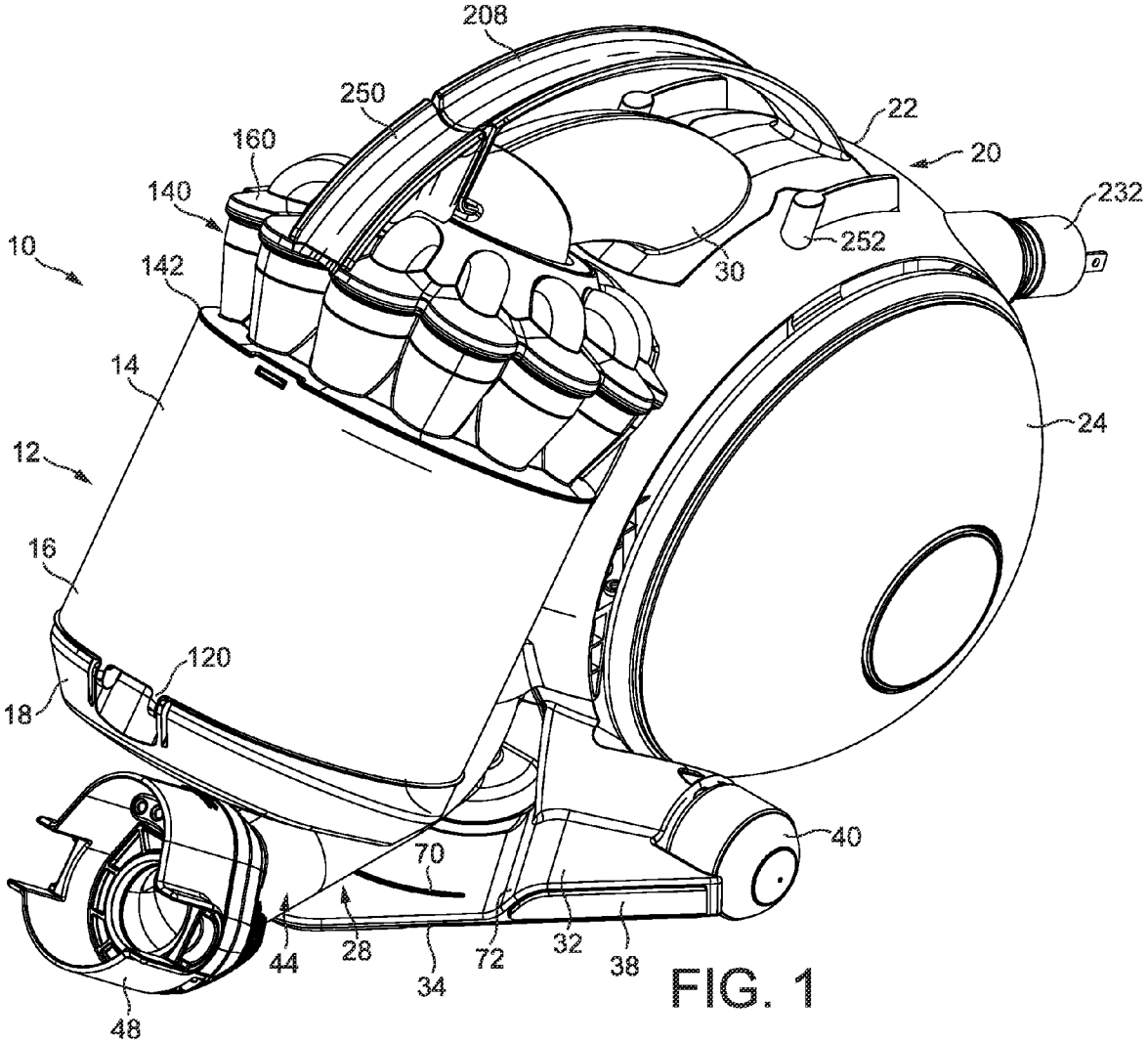
FIG. 1 is a front perspective view, from above, of a vacuum cleaner.

FIG. 1 illustrates an external view of a cleaning appliance in the form of a vacuum cleaner 10. The vacuum cleaner 10 is of the cylinder, or canister, type. In overview, the vacuum cleaner 10 comprises separating apparatus 12 for separating dirt and dust from a fluid flow. The separating apparatus 12 is preferably in the form of cyclonic separating apparatus, and comprises an outer bin 14 having an outer wall 16 which is substantially cylindrical in shape. The lower end of the outer bin 14 is closed by curved base 18 which is pivotably attached to the outer wall 16. A motor-driven fan unit for generating suction for drawing dirt laden fluid into the separating apparatus 12 is housed within a rolling assembly 20 located behind the separating apparatus 12. The rolling assembly 20 comprises a main body 22 and two wheels 24, 26 (see FIG. 2(*a*)) rotatably connected to the main body 22 for engaging a floor surface. An inlet duct 28 extending beneath the separating apparatus 12 conveys dirt-bearing fluid into the separating apparatus 12, and an outlet duct 30 conveys fluid exhausted from the separating apparatus 12 into the rolling assembly 20. The inlet duct 28 is connected to a hose of a hose and wand assembly (not shown) which the user pulls to maneuver the vacuum cleaner 10 over the floor surface.

A chassis 32 is connected to the main body 22 of the rolling assembly 20. In this example, the chassis 32 is integral with part of the main body 22 of the rolling assembly 20. The chassis 32 is generally in the shape of an arrow head pointing forwardly from the rolling assembly 20. The chassis 32 comprises side edges 34 which extend rearwardly and outwardly from the front tip 36 of the chassis 32, shown in FIGS. 5(*b*) and 6(*a*). The front tip 36 of the chassis 32 is located on an axis A extending substantially perpendicular to a vertical plane passing through the center of the rolling assembly 20. The direction in which the vacuum cleaner 10 moves over a floor surface during a cleaning operation extends along the axis A. The angling of the side edges 34 relative to the axis A can assist in maneuvering the vacuum cleaner 10 around corners, furniture or other items upstanding from the floor surface, as upon contact with such an item these side edges 34 tend to slide against the upstanding item to guide the rolling assembly 20 around the upstanding item. As illustrated in the figures, bumpers or pads 38 may be attached to the side edges 34.

Figure 3:
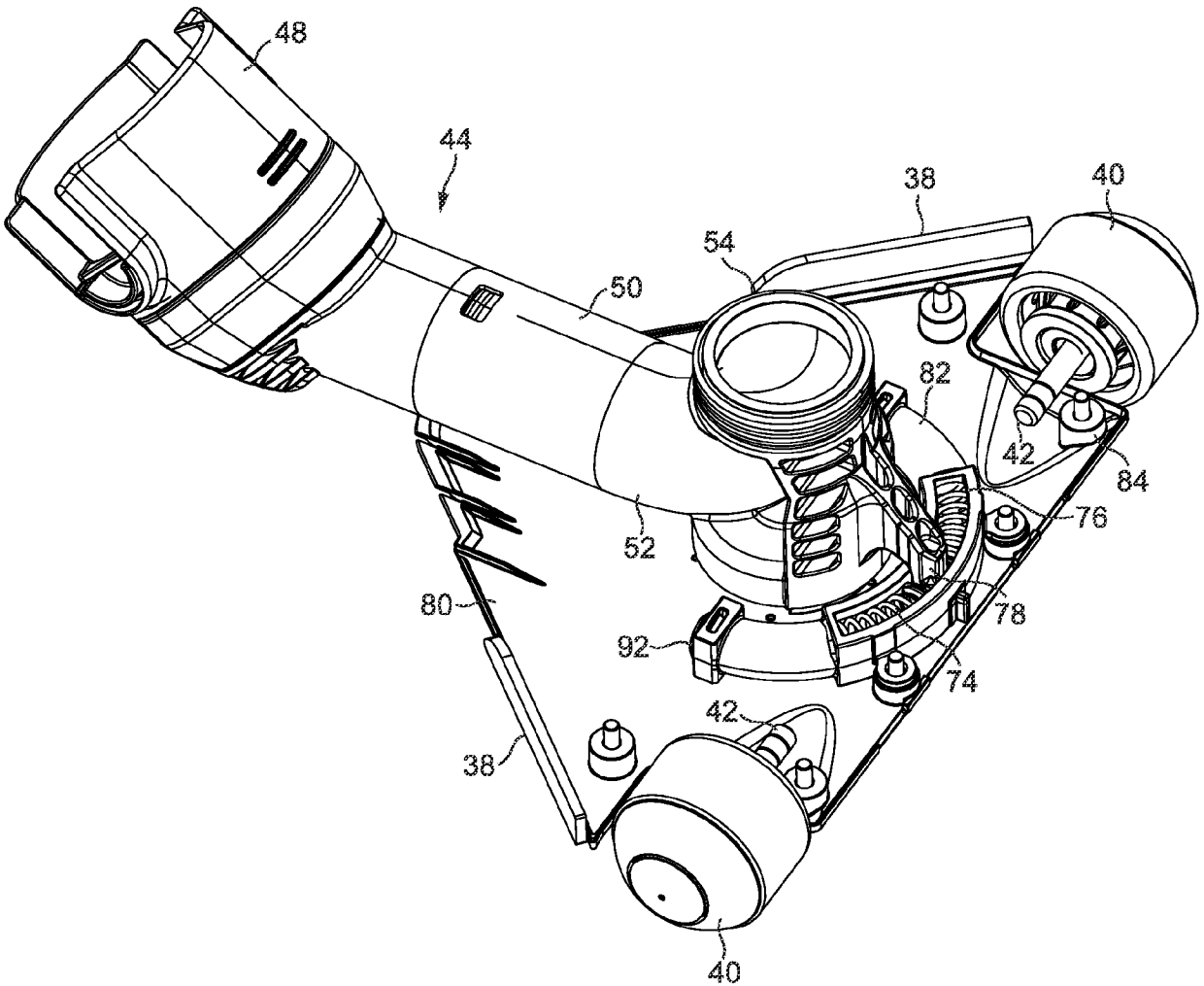
FIG. 3 is a rear perspective view, from above, of the chassis base plate, wheel assemblies, inlet section of the inlet duct and biasing arrangements of the vacuum cleaner.

A pair of wheels 40 for engaging the floor surface is connected to the chassis 32. The wheels 40 are located behind the side edges 34 of the chassis 32, and in front of the wheels 24, 26 of the rolling assembly 20. As shown in FIG. 3, each wheel 40 is mounted on a respective axle 42 fitted to the chassis 32, for example by press fitting or overmolding, so that the wheel 40 rotates relative to the axle 42, and thus relative to the chassis 32. Each axle 42 is aligned along an axis which is substantially perpendicular to the axis A so that the wheels 40 rotate to move the vacuum cleaner 10 in a direction extending along the axis A.

The wheels 40 also provide support members for supporting the rolling assembly 20 as the vacuum cleaner 10 is maneuvered over a floor surface by restricting rotation of the rolling assembly 20 about the axis A. For increased support to the rolling assembly 20, the distance between the points of contact of the wheels 40 with the floor surface is greater than that between the points of contact of the wheels 24, 26 of the rolling assembly 20 with that floor surface.

Figure 2A:
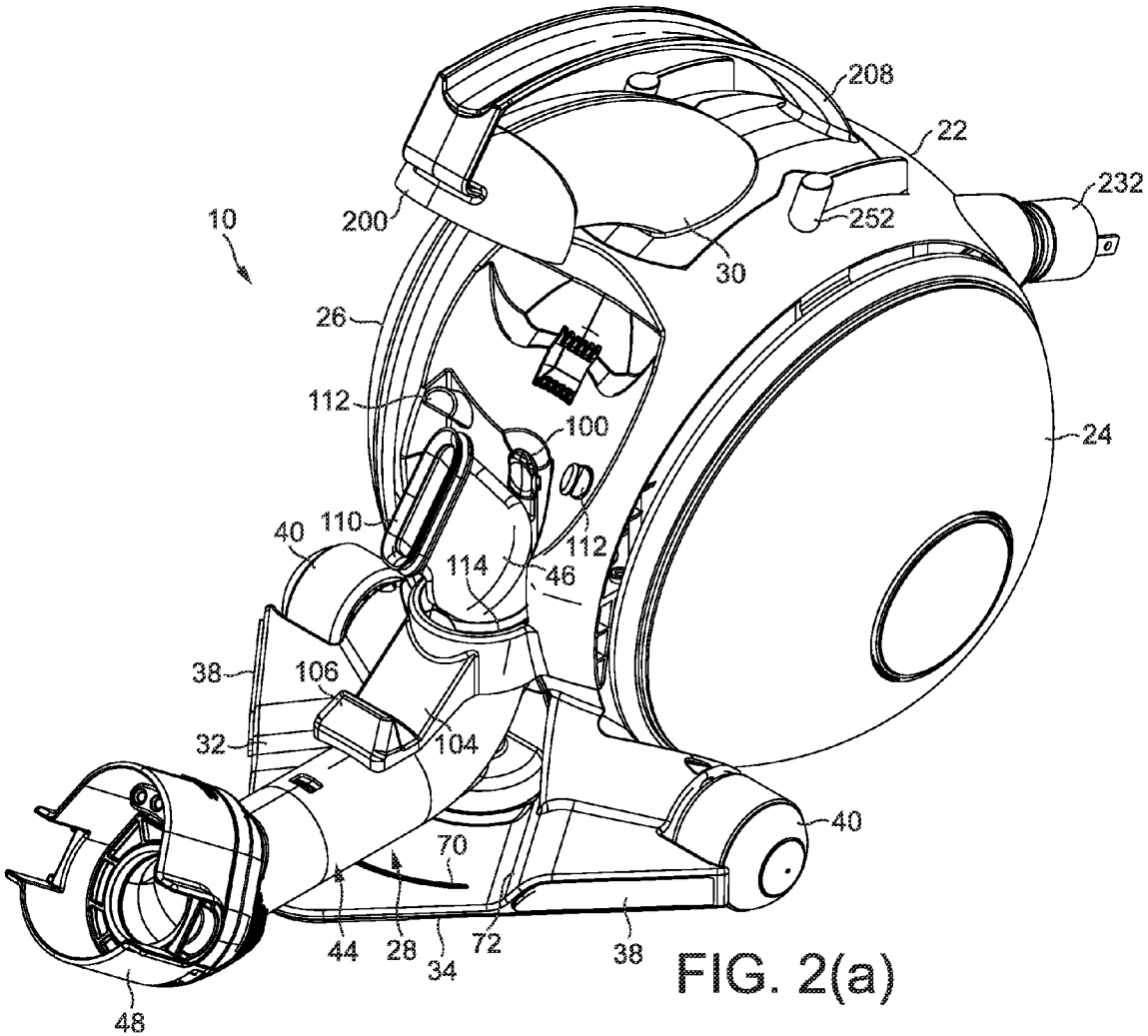
FIG. 2(*a*) is a front perspective view, from above, of the vacuum cleaner, with a separating apparatus of the vacuum cleaner removed, FIG. 2(*b*) is a side view of the same, and FIG. 2(*c*) is a top view of the same.
Figure 2B:
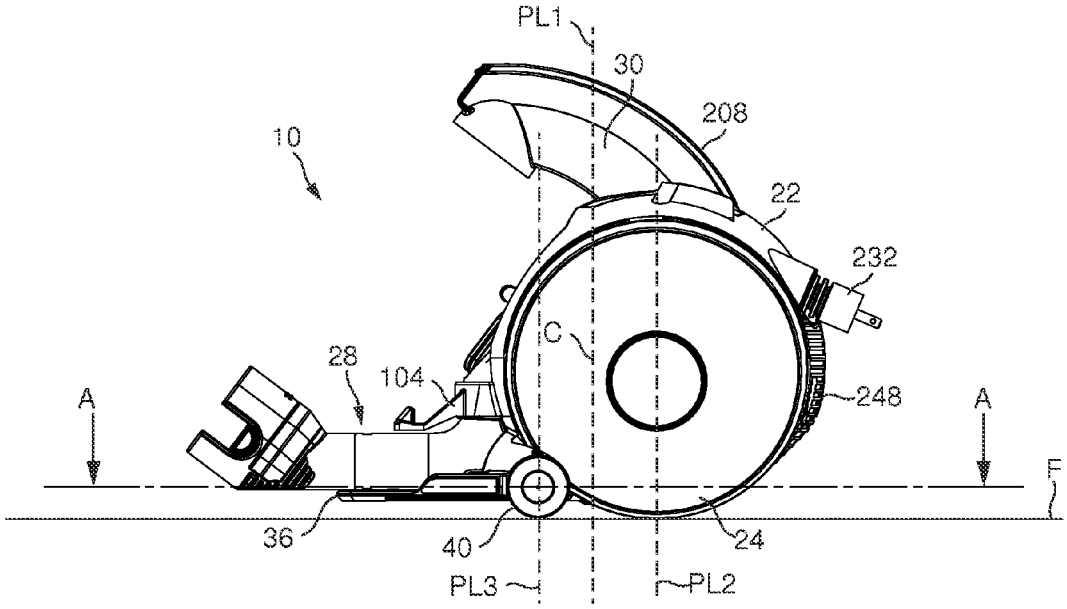
Figure 2C:
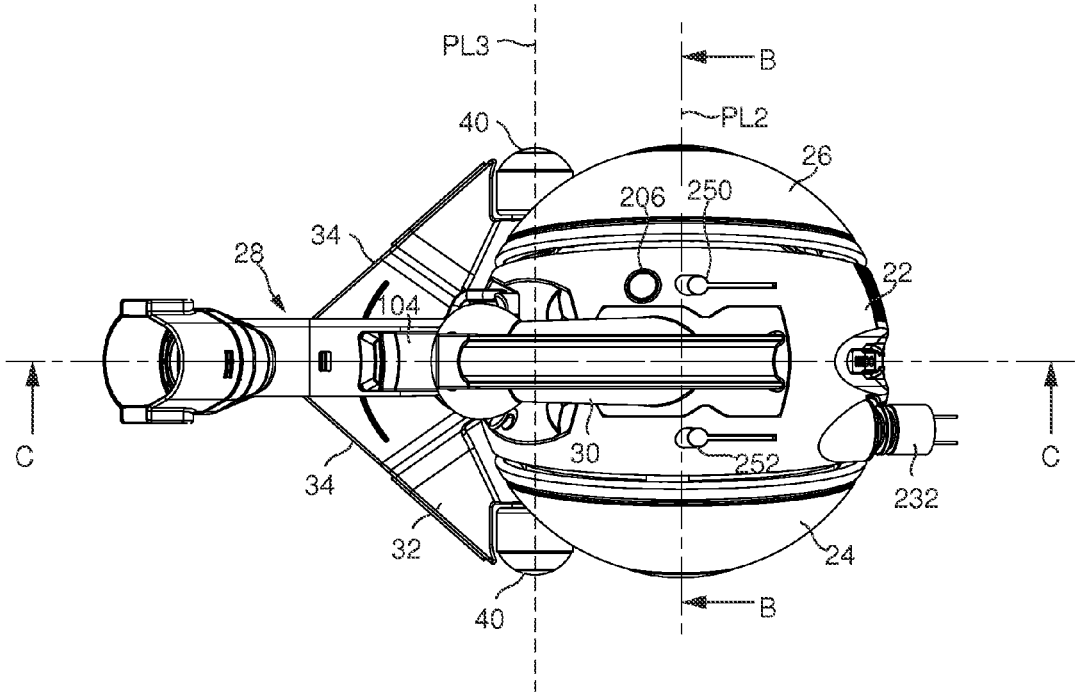

As shown in FIG. 2(*b*), the components of the vacuum cleaner 10 are arranged so that, when the vacuum cleaner 10 is located on a substantially horizontal floor surface F, the center of gravity C of the vacuum cleaner 10 is located within the rolling assembly 20. The center of gravity C is located in a first vertical plane PL1 which passes between a second vertical plane PL2 containing the points of contact between the wheels 24, 26 of the rolling assembly 20 and the floor surface, and a third vertical plane PL3 containing the points of contact between the wheels 40 and the floor surface, preferably substantially mid-way between the two planes PL2, PL3. This can further enhance the stability of the vacuum cleaner 10 as it is maneuvered over the floor surface.

The location of the center of gravity C is indicated above for a situation in which the separating apparatus 12 is connected to the vacuum cleaner 10, and the separating apparatus 12 is in an unloaded state, and with no hose and wand assembly connected to the vacuum cleaner 10.

To reverse the direction in which the vacuum cleaner 10 is moving over a floor surface, the user may raise the wheels 40 of the chassis 32 from the floor surface, using the hose of the hose and wand assembly so that the vacuum cleaner 10 tilts backwards on to the wheels 24, 26 of the rolling assembly 20. Using the hose, the vacuum cleaner 10 may then be "spun" around the point of contact between the rolling assembly 20 and the floor surface until the vacuum cleaner 10 is facing in the required direction. The hose may then lowered to bring the wheels 40 back into contact with the floor surface, and the vacuum cleaner 10 pulled in the required direction.

To enable the vacuum cleaner 10 to be maneuvered smoothly around an object or the corner of a wall during a cleaning operation, part of the inlet duct 28 is connected to the chassis 32 for pivoting movement relative to the chassis 32, and thus relative to the rolling assembly 20. FIGS. 2(*a*) to 2(*c*) illustrate the vacuum cleaner 10 with the separating apparatus 12 to reveal the inlet duct 28. The removal of the separating apparatus 12 from the vacuum cleaner 10 is described in more detail below. The inlet duct 28 comprises an inlet section 44 for receiving the dirt-bearing fluid flow from the hose and wand assembly, and an outlet section 46 for coupling the inlet section 44 to the separating apparatus 12 to convey the dirt-bearing fluid flow into the separating apparatus 12. The inlet section 44 is pivotably connected to the chassis 32, whereas the outlet section 46 is connected to the main body 22 of the rolling assembly 20 so that the inlet section 44 is pivotable relative to the outlet section 46. Alternatively, the outlet section 46 may be connected to the chassis 32.

Figure 4:
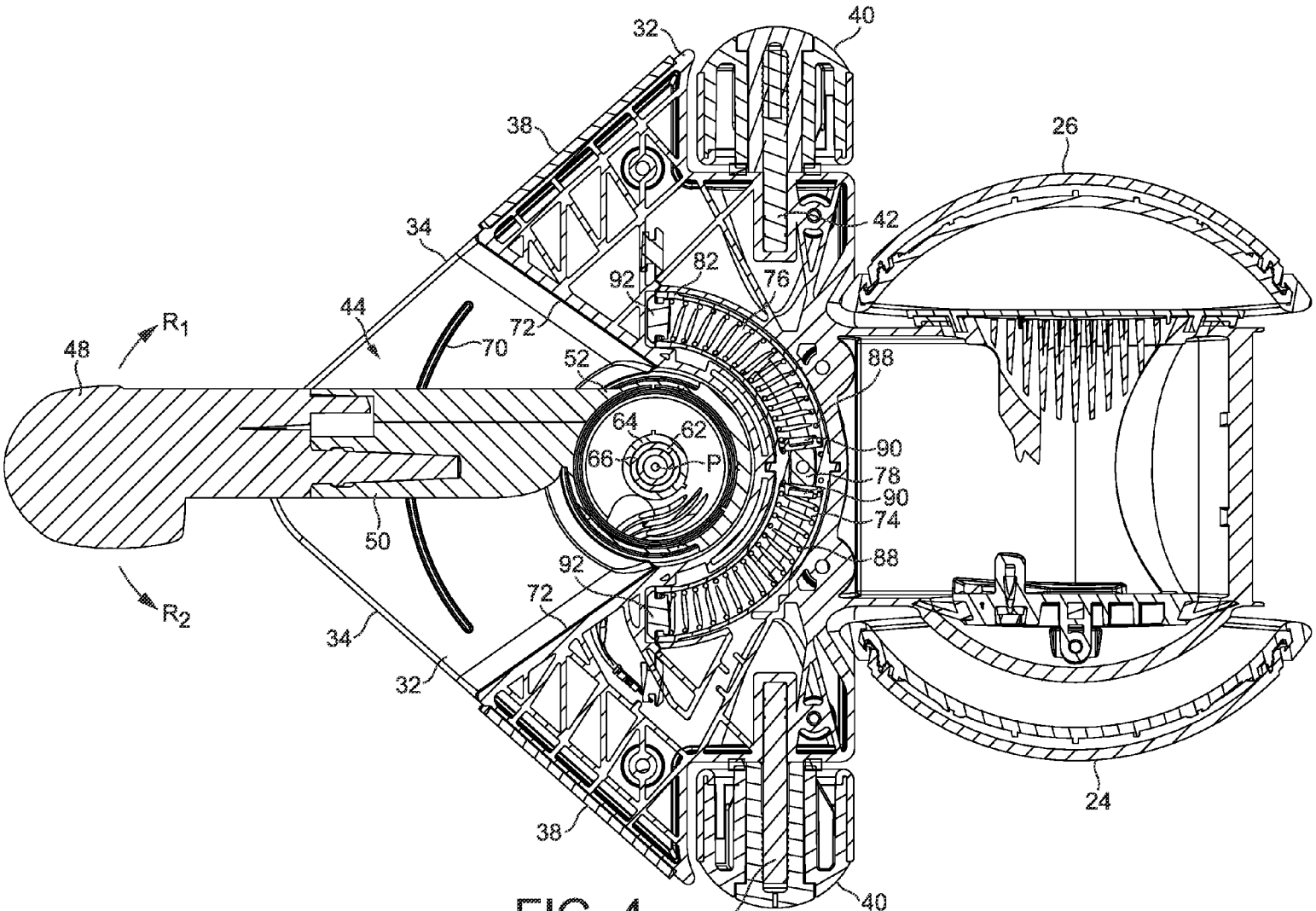
FIG. 4 is a top sectional view taken along line A-A in FIG. 2(*b*)
Figure 6A:
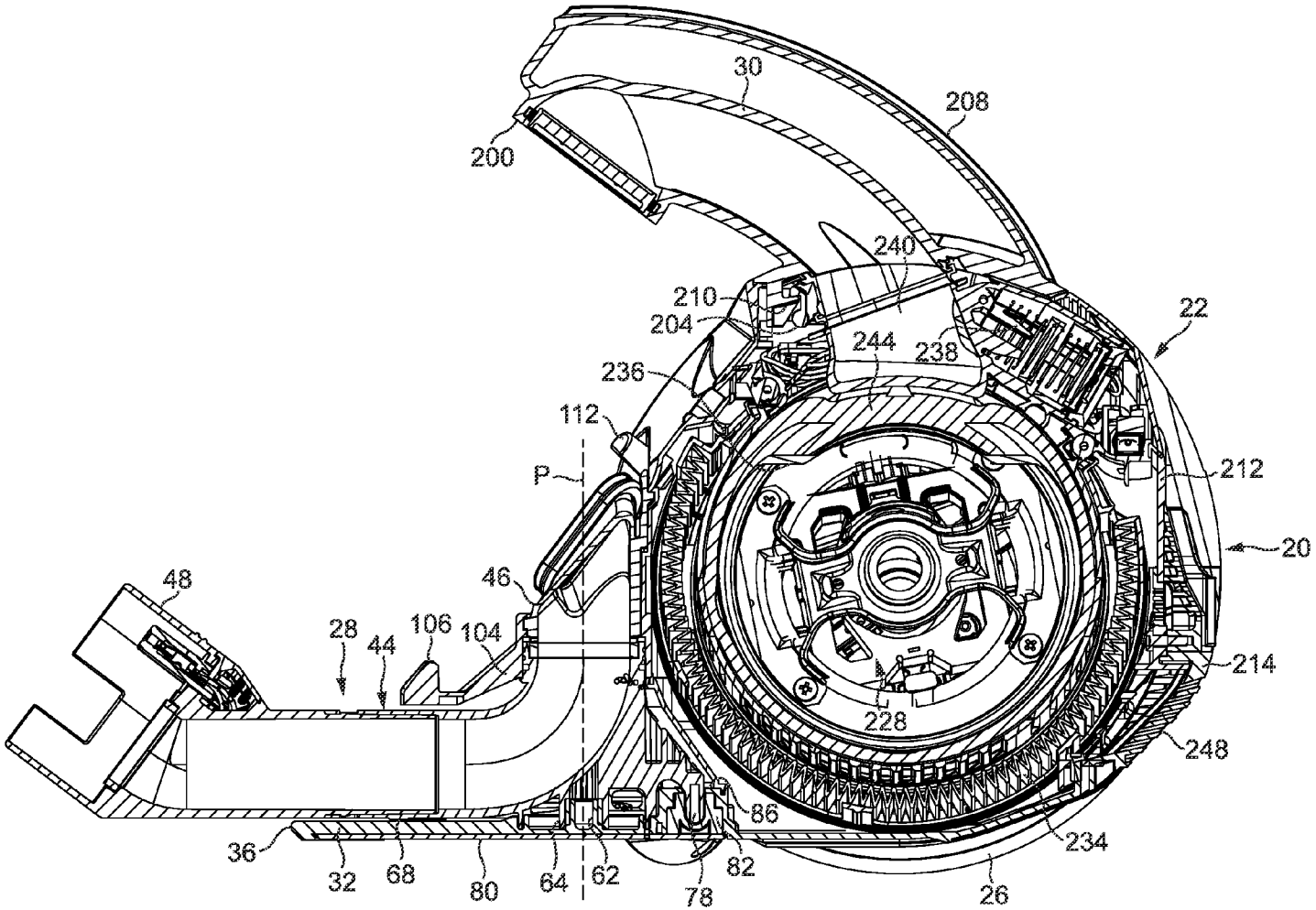
FIG. 6(*a*) is a side sectional view taken along line C-C in FIG. 2(*c*), and FIG. 6(*b*) is a magnified view of part of FIG. 6(*a*)
Figure 6B:
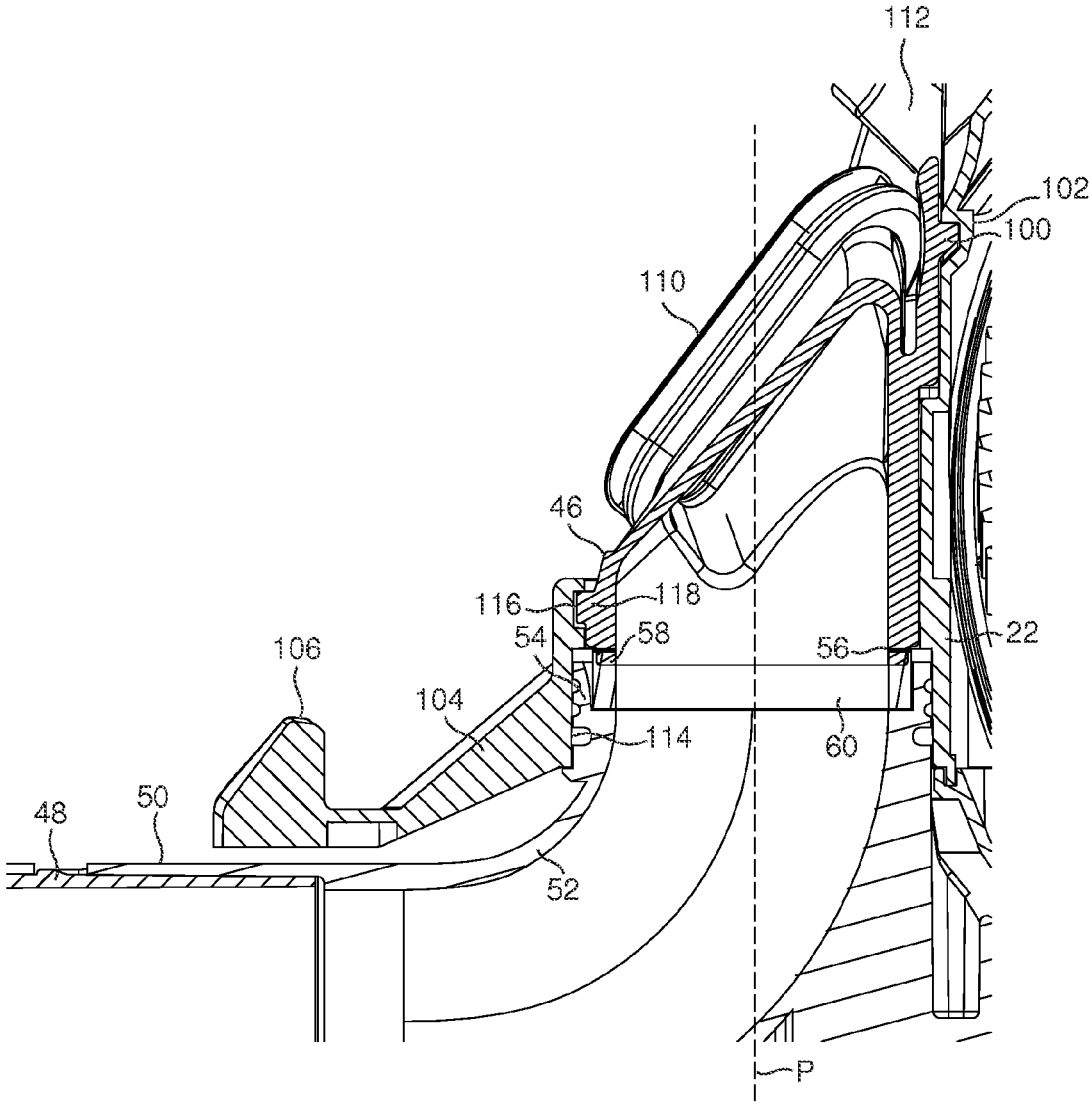

With particular reference to FIGS. 3, 4, 6(*a*) and 6(*b*), in this example the inlet section 44 of the inlet duct 28 comprises a plurality of components. The inlet section 44 comprises a coupling 48 for electrical and/or physical connection to a wand and hose assembly (not shown) for conveying the duct-bearing fluid flow to the inlet duct 28. The wand and hose assembly is connected to a cleaner head (not shown) comprising a suction opening through which a dirt-bearing fluid flow is drawn into the vacuum cleaner 10. The coupling 48 is connected to one end of a cylindrical section 50 of the inlet duct 28. Of course, the section 50 may have an alternative cross-sectional shape, such as an elliptical or polyhedral shape. The other end of the cylindrical section 50 is connected to a curved section 52 of the inlet duct 28. In this example, the cylindrical section 50 is integral with the curved section 52, but these two sections 50, 52 of the inlet duct 28 may be integrally formed. The curved section 52 is shaped to change the direction in which the fluid flows through the inlet duct 28 by around 90°. The curved section 52 has a fluid outlet 54 which is concentric with, and located immediately below, a fluid inlet 56 of the outlet section 46 of the inlet duct 28. One or more annular sealing members 58, 60 are located between the fluid outlet 54 and the fluid inlet 56 to maintain an air tight seal and a relatively low frictional force therebetween during pivoting movement of the inlet section 44 relative to the outlet section 46.

The inlet section 44 is mounted on a cylindrical spindle 62 extending upwardly from the upper surface of the chassis 32. The curved section 52 comprises a cylindrical boss 64 depending downwardly therefrom and which is located over the spindle 62 so as to be substantially concentric with the spindle 62. A plain bearing or sleeve 66 may be located between the spindle 62 and the boss 64 to minimize friction therebetween during rotation of the boss 64 about the spindle 62 and to ensure accurate alignment between the spindle 62 and the boss 64. Alternatively, the spindle 62 may be formed from a low friction material. The longitudinal axis of the spindle 62 thus defines the pivot axis P about which the inlet section 44 pivots relative to the chassis 32 and the outlet section 46. The pivot axis P passes through the center of the fluid outlet 54 of the inlet section 44 and the fluid inlet 56 of the outlet section 46. The pivot axis P is substantially vertical when the vacuum cleaner 10 is located on a horizontal floor surface. As the curved section 52 is shaped with a 90° bend, the longitudinal axis of the cylindrical section 50 is substantially orthogonal to the pivot axis P and so during pivoting movement of the inlet section 44 the cylindrical section 50 sweeps orthogonally about the pivot axis P.

The pivoting movement of the inlet section 44 relative to the chassis 32 is guided by a pin or rib 68 depending from the cylindrical section 50. The rib 68 is moveable within a curved groove or slot 70 which extends about the pivot axis P, and which is formed in a portion of the upper surface of the chassis 32 which is substantially orthogonal to the pivot axis P.

Figure 5A:
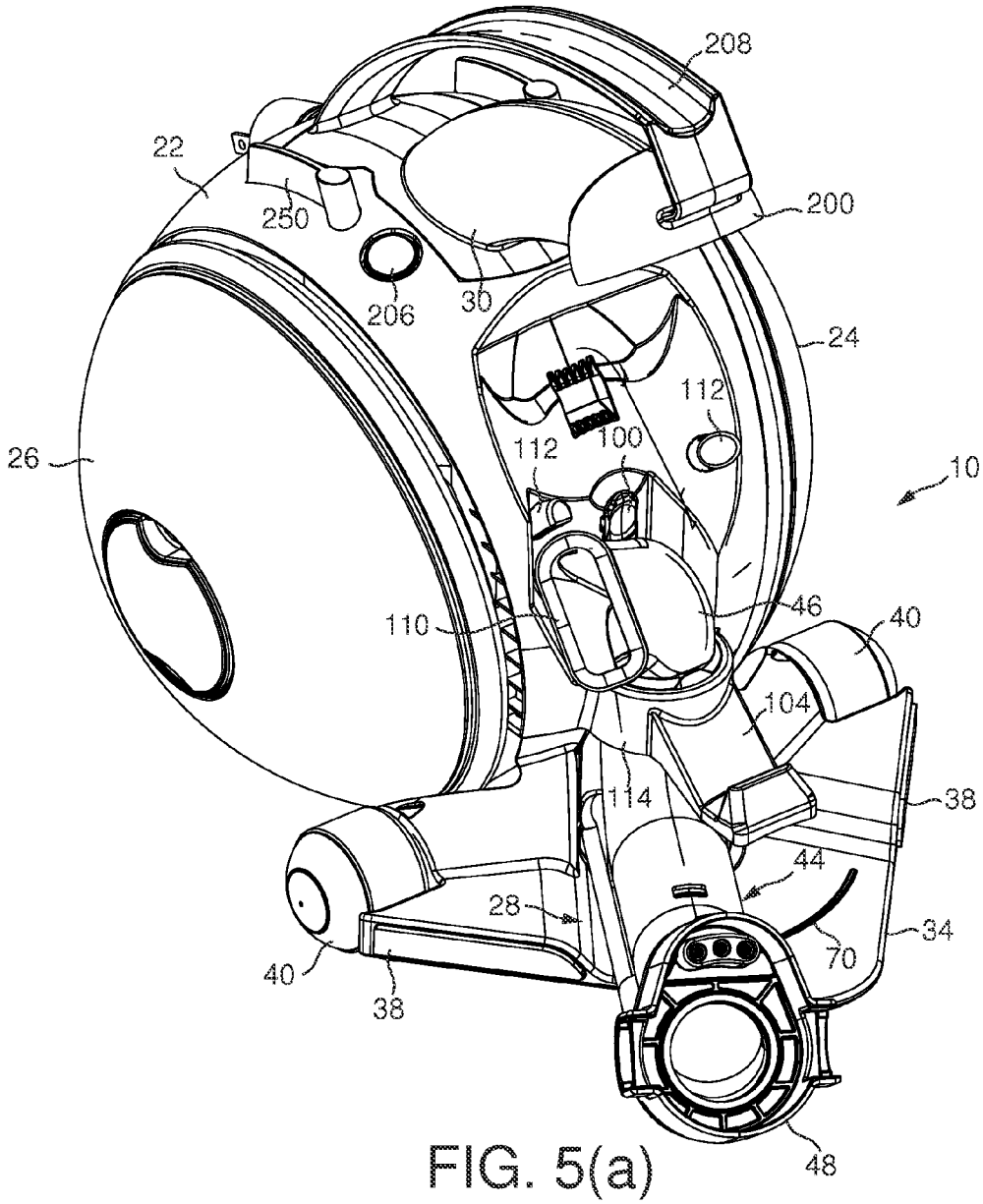
FIG. 5(*a*) is a front perspective view, from above, of the vacuum cleaner with the separating apparatus removed and the inlet section of the inlet duct pivoted relative to the chassis.
Figure 5B:
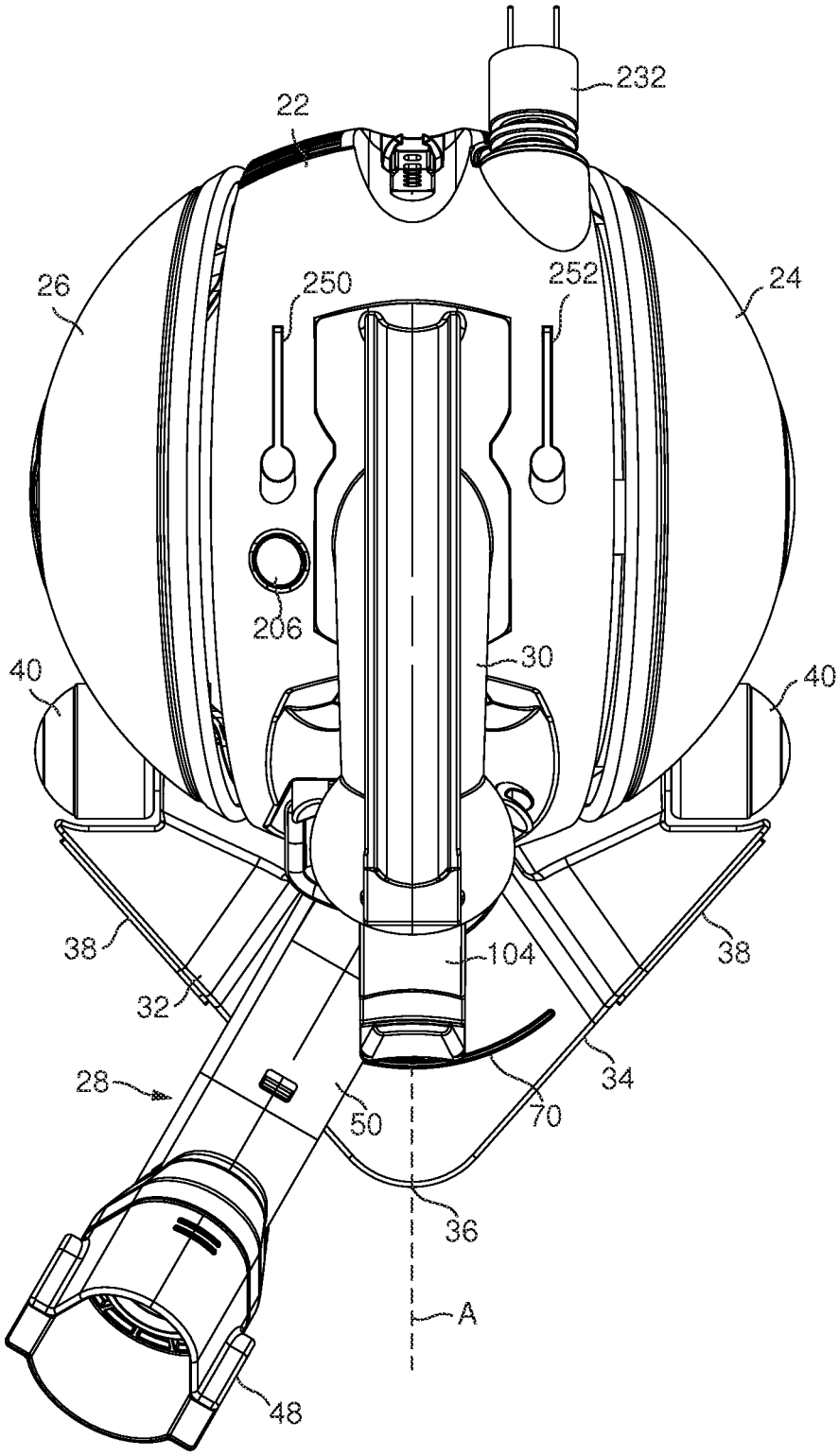

The inlet section 44 is pivotable about the pivot axis P by an angle of $\pm\alpha°$ from a central, rest position. The angle $\alpha$ is preferably in the range from 15 to 45°, and in this example is around 30°. The inlet section 44 is illustrated in its rest position in FIGS. 1 to 4, 6(*a*) and 6(*b*). In this rest position, the inlet section 44 is aligned along the axis A, that is, with the longitudinal axis of the cylindrical section 50 of the inlet section 44 parallel to the axis A. FIGS. 5(*a*) and 5(*b*) illustrate the vacuum cleaner 10 with the inlet section 44 pivoted by around 30° in the angular direction $R_1$, indicated in FIG. 4, from the rest position. The extent of the pivoting movement of the inlet section 44 away from the rest position is restricted by the abutment of the side of the inlet section 44 with one of a pair of raised walls 72 of the chassis 32, as illustrated in FIG. 1.

The inlet section 44 of the inlet duct 28 is biased towards a rest position. Consequently, when the inlet section 44 is pivoted away from the rest position during the maneuvering the vacuum cleaner 10 over a floor surface, for example while the vacuum cleaner 10 is being pulled around an object or piece of furniture, the inlet duct 44 will return automatically to its rest position when the vacuum cleaner 10 has moved away from the object.

The inlet section 44 is biased towards its rest position by a biasing system which engages the inlet section 44 to urge the inlet section 44 towards its rest position. With reference now to FIGS. 3 and 4, in this example the biasing system comprises a plurality of biasing arrangements 74, 76 located on opposite sides of the inlet section 44. A first biasing arrangement 74 is arranged to urge the inlet section 44 towards the rest position when it moves in angular direction R1 away from the rest position, and a second biasing arrangement 76 is arranged to urge the inlet section 44 towards the rest position when it moves in angular direction $R_2$, opposite to $R_1$, away from the rest position.

The inlet section 44 comprises a return member for engaging the biasing arrangements 74, 76 as the inlet section 44 is pivoted away from the rest position. In this example, the return member is in the form of an arm 78 connected to the curved section 52, and generally on the opposite side of the curved section 52 to the cylindrical section 50.

The biasing arrangements 74, 76 are located beneath the chassis 32. The vacuum cleaner 10 includes a chassis base plate 80 which is connected to the lower section of the chassis 32, and the biasing arrangements 74, 76 are located within a housing 82 located between the chassis 32 and the chassis base plate 80. During assembly, the biasing arrangements 74, 76 are located within the housing 82, and the housing 82 is connected to the base plate 80. The chassis 32 is then connected to the base plate 80, for example by means of screws or other connectors 84 inserted through apertures in the base plate 80. The inlet section 44 is then mounted on the chassis 32. To engage the biasing arrangements 74, 76, the arm 78 of the inlet section 44 extends through a curved slot 86, indicated in FIG. 6(*a*), formed in the chassis 32 behind the spindle 62 to enter the housing 82.

With particular reference to FIG. 4, the housing 82 extends about the pivot axis P. When the inlet section 44 is in its rest position, the arm 78 is located centrally within the housing 82, between the biasing arrangements 74, 76. Each biasing arrangement 74, 76 is located within a respective compartment of the housing 82, between which the arm 78 is located when in its rest position. Each biasing arrangement 74, 76 comprises a resilient element, in this example in the form of a helical compression spring 88, and a piston, in this example in the form of a circular disc 90. The spring 88 urges the disc 90 against an annular seat located at one end of the compartment. The other end of the compartment is closed by a closure member 92 connected to the housing 82.

When the inlet section 44 is pivoted about the pivot axis P in the direction $R_1$, for example, the arm 78 enters the compartment housing the biasing arrangement 74. The biasing force of the spring 88 is selected to allow the aim 78 to move within the compartment towards the closure member 92, against the biasing force of the spring 88, without the user having to apply an excessive force to the inlet section 44 using the hose and wand assembly attached thereto. When the user relaxes the force applied to the inlet section 44, for example when the vacuum cleaner 10 has moved beyond an obstacle on the floor surface, the biasing force of the spring 88 exceeds the force applied to the inlet section 44. This causes the spring 88 to urge the disc 90 back towards its seat, thereby returning the arm 78 automatically to its rest position.

As mentioned above, the outlet section 46 of the inlet duct 28 provides a static coupling between the separating apparatus 12 and the inlet section 44 of the inlet duct 28. The fluid inlet 56 of the outlet section 46 is mounted on, and supported by, the annular sealing members 58, 60 of the inlet duct 28. The outlet section 46 is removably connected to the main body 22 of the rolling assembly 20 to allow the outlet section 46 to be removed from the vacuum cleaner 10 by the user to allow any blockages within the outlet section 46 to be removed. The removal of the outlet section 46 from the vacuum cleaner 10 also facilitates the removal of blockages from within the inlet section 44 of the inlet duct 28. As shown in FIG. 6(*b*), the outlet section 46 comprises a manually operable, resilient catch 100 which extends upwardly from a rear surface of the outlet section 46. The catch 100 engages a catch face 102 located on the main body 22 of the rolling assembly 20, or alternatively on the chassis 32, to retain the outlet section 46 on the main body 22. To remove the outlet section 46, the user pulls the catch 100 away from the catch face 102 and lifts the outlet section 46 away from the inlet section 44.

The vacuum cleaner 10 comprises a support 104 for supporting the separating apparatus 12. The support 104 is connected to, and in this example is integral with, part of the main body 22 of the rolling assembly 20. The support 104 extends forwardly from the main body 22 so as to extend over the inlet section 44 of the inlet duct 28. The main body 22, and therefore the support 104, is formed from a relatively rigid material, preferably a plastics material, so that, when the separating apparatus is mounted on the support 104, the support 104 does not deform to such an extent as to engage the upper surface of the inlet section 44, and thereby interfere with the pivoting movement of the inlet section 44 relative to the chassis 32. The end of the support 104 which is remote from the main body 22 comprises a spigot 106 which extends upwardly therefrom for location within a recess (not shown) formed in the base 18 of the outer bin 14. The location of the spigot 106 within the recess ensures correct angular alignment of the separating apparatus 12 relative to the support 104 when it is mounted on the support 104, so that a fluid inlet 108 of the separating apparatus 12 is located over and against a fluid outlet 110 of the outlet section 46. The outlet section 46 is provided with a flexible annular seal surrounding the fluid outlet 110 for forming an air tight seal against the periphery of the fluid inlet 108 of the separating apparatus 12.

When the separating apparatus 12 is mounted on the support 104, the longitudinal axis of the outer bin 14 is inclined to the pivot axis P, in this example by an angle in the range from 30 to 40°. The outer wall 16 of the outer bin 14 is supported by a pair of resilient supports 112 mounted on the main body 22 of the rolling assembly 20.

To provide the vacuum cleaner 10 with a compact appearance, the main body 22 and the support 104 together define a sleeve 114 through which the inlet duct 28 extends. The longitudinal axis of the sleeve 114 is co-linear with the pivot axis P of the inlet section 44. The inlet section 44 and the outlet section 46 of the inlet duct 28 are located on opposite sides of the sleeve 114. The sleeve 114 thus surrounds the fluid outlet 54 of the inlet section 44, the fluid inlet 56 of the outlet section 56, and the annular sealing members 58, 60. The inner surface of the sleeve 114 comprises a recess 116 for receiving a detent 118 located on the outer surface of the outlet section 46 when the outlet section 46 is mounted on the main body 22. The recess 116 has substantially the same profile as the detent 118 to inhibit rotation of the outlet section 46 relative to the sleeve 114, and therefore relative to the separating apparatus 12 and the main body 22, as the inlet section 44 pivots about the pivot axis P.

Figure 7B:
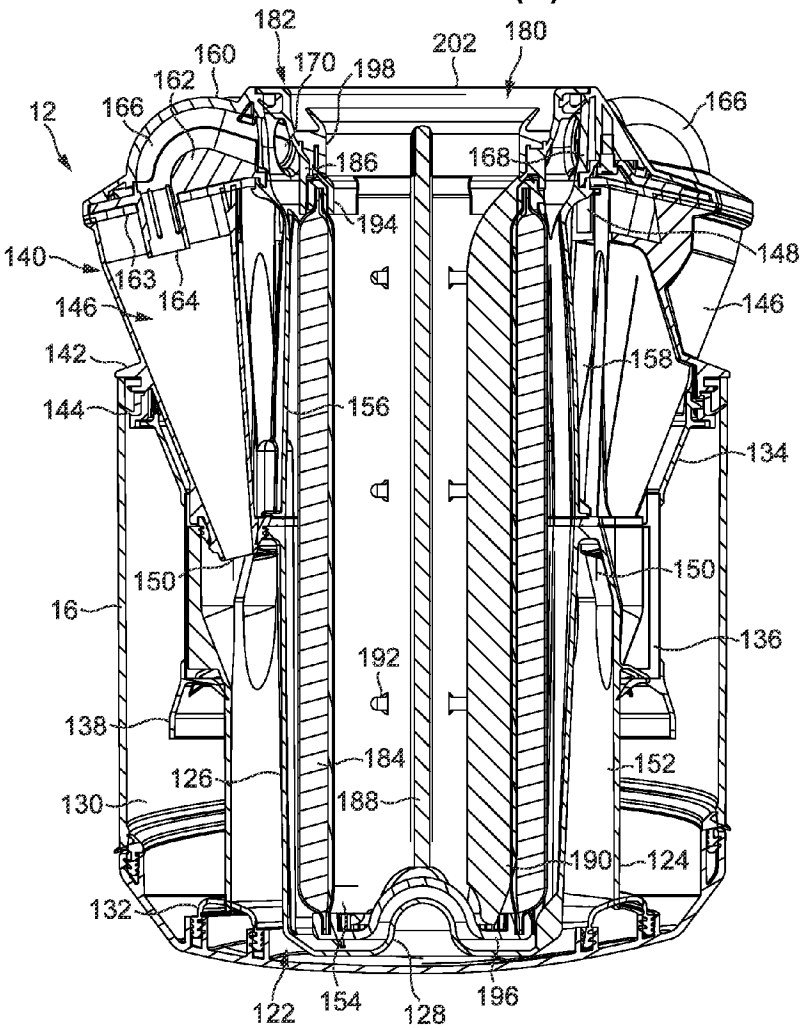
FIG. 7(*a*) is a top view of the separating apparatus, and FIG. 7(*b*) is a sectional view taken along line D-D in FIG. 7(*a*)
Figure 7A:
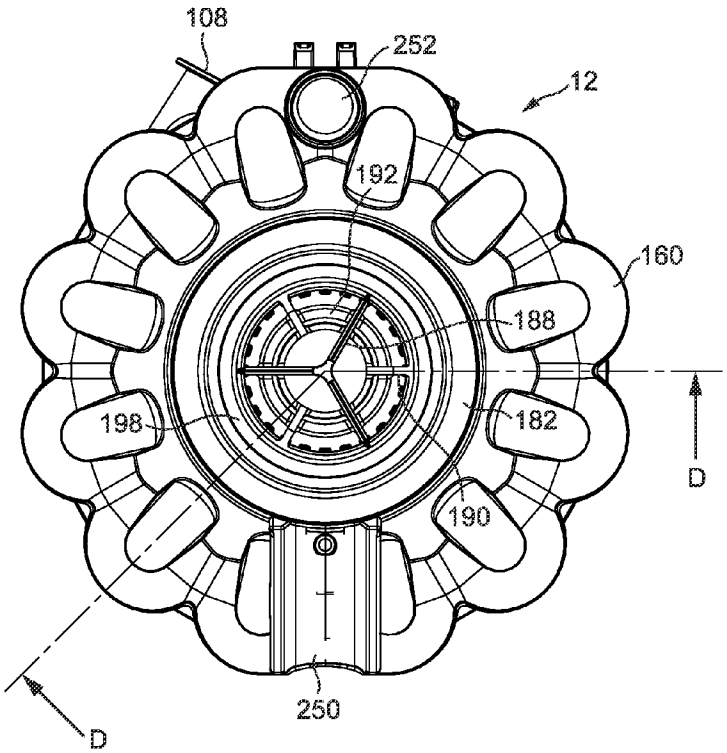

The separating apparatus 12 is illustrated in FIGS. 7(*a*) and 7(*b*). The specific overall shape of the separating apparatus 12 can be varied according to the size and type of vacuum cleaner in which the separating apparatus 12 is to be used. For example, the overall length of the separating apparatus 12 can be increased or decreased with respect to the diameter of the apparatus, or the shape of the base 18 can be altered.

As mentioned above, the separating apparatus 12 comprises an outer bin 14 which has an outer wall 16 which is substantially cylindrical in shape. The lower end of the outer bin 14 is closed by a base 18 which is pivotably attached to the outer wall 16 by means of a pivot 120 and held in a closed position by a catch (not shown) which engages a groove located on the outer wall 16. In the closed position, the base 18 is sealed against the lower end of the outer wall 16. The catch is resiliently deformable so that, in the event that downward pressure is applied to the uppermost portion of the catch, the catch will move away from the groove and become disengaged therefrom. In this event, the base 18 will drop away from the outer wall 16.

With particular reference to FIG. 7(*b*), the separating apparatus 12 further comprises a dust collector 122 located within the outer bin 14. The dust collector 122 has a generally cylindrical outer wall 124, and a generally cylindrical inner wall 126 connected to the outer wall 124 at the upper end of the dust collector 122, and a base 128 which closes the lower end of the inner wall 126. The outer wall 124 of the dust collector 122 is located radially inwardly of the outer wall 16 and spaced therefrom so as to form an annular chamber 130 therebetween. The outer wall 124 of the dust collector 122 meets the base 18 (when the base 18 is in the closed position) and is sealed against an annular sealing member 132 carried by the base 18. The fluid inlet 108 is arranged tangentially to the outer bin 14 (as shown in FIG. 6(*a*)) so as to ensure that incoming dirty fluid is forced to follow a helical path around the annular chamber 124.

A fluid outlet from the annular chamber 130 is provided in the form of a perforated shroud. The shroud has an upper section 134 formed in a frusto-conical shape, a cylindrical section 136 and a skirt 138 depending therefrom. A large number of apertures are formed in the cylindrical section 136. The skirt 138 tapers outwardly from the cylindrical section 136 in a direction towards the outer wall 16.

The upper section 134 of the shroud is connected to a cyclone pack 140. The cyclone pack 140 is mounted on the upper end of the dust collector 122, and comprises a circumferential flange 142 for engaging the upper end of the outer bin 14. The cyclone pack 140 carries an annular seal 144 for sealing against the outer wall 16 adjacent the upper end of the outer bin 14.

The cyclone pack 140 comprises an annular array of cyclones 146. The cyclones 146 are arranged in parallel. In the preferred embodiment there are twelve cyclones 146 for this bin diameter arranged in a ring which is centered on a longitudinal axis of the outer bin 14. Each cyclone 146 has an axis which is inclined downwardly and towards the longitudinal axis. The twelve cyclones 146 can be considered to form a second cyclonic separating unit, with the annular chamber 130 forming the first cyclonic separating unit. In the second cyclonic separating unit, each cyclone 146 has a smaller diameter than the annular chamber 124 and so the second cyclonic separating unit is capable of separating finer dirt and dust particles than the first cyclonic separating unit. It also has the added advantage of being challenged with a fluid flow which has already been cleaned by the first cyclonic separating unit and so the quantity and average size of entrained particles is smaller than would otherwise have been the case. The separation efficiency of the second cyclonic separating unit is higher than that of the first cyclonic separating unit.

Each cyclone 146 is identical to the other cyclones 146, and comprises a cylindrical upper portion having a tangential inlet 148 and a tapering portion depending from the upper portion. The tapering portion of each cyclone 146 is frusto-conical in shape and terminates in a cone opening 150. Each tapering portion protrudes through an aperture formed in the upper end of the dust collector 122 so that the cone opening 150 is located in a chamber 152 located between the outer wall 124 and the inner wall 126 of the dust collector 122.

The inner wall 126 and the base 128 of the dust collector 122 form a lower section of a filter housing 154. An upper section of the filter housing 154 is provided by a generally annular filter housing member 156 mounted on the upper end of the dust collector 122, and which forms a generally continuous inner wall of the filter housing 154 with the inner wall 126 of the dust collector 122. The cyclone pack 140 surrounds the filter housing member 156 and defines with the filter housing member 156 a plenum chamber 158 for conveying fluid which has passed through the apertures in the shroud to the inlets 148 of the cyclones 146.

The open upper ends of the cyclones 146 are closed by an annular exhaust manifold. The exhaust manifold comprises an upper section 160 and a lower section 162. An apertured sealing member 163 may be provided between the cyclone pack 140 and the lower section 162 of the exhaust manifold.

The lower section 162 of the exhaust manifold comprises a vortex finder 164 to allow fluid to exit the cyclone 146. Each vortex finder 164 communicates with a manifold finger 166 defined between the upper and lower sections 160, 162 of the exhaust manifold. Each manifold finger 166 is a generally inverted U-shape and extends from the upper end of a respective cyclone 146 to a generally cylindrical exhaust manifold wall 168 formed in the upper section 160 of the exhaust manifold. The wall 168 comprises a plurality of apertures 170 each for receiving fluid from a respective one of the manifold fingers 166. The wall 168 extends about a bore which is generally co-axial with the outer wall 16.

The apertures 170 convey fluid into the filter housing 154. A filter assembly 180 is located within the filter housing 154. The filter assembly 180 is inserted into the filter housing 154 through the bore of the upper section 162 of the exhaust manifold. The filter assembly 180 comprises a body 182 and a filter 184 mounted on the filter body 182. The filter body 182 is preferably a single-piece item, preferably molded from plastics material, but alternatively the filter body 182 may formed from a plurality of components connected together. The filter body 182 is generally tubular in shape, and comprises an annular body 186, a set of radially extending elongate spokes 188 connected to the inner surface of the body 186 and depending therefrom. A set of elongate fins 190 is connected between the spokes 188 so that each fin 190 is located between adjacent spokes 188. The fins 190 are connected to the spokes 188 by connectors 192. The spokes 188 and the fins 190 together provide a support for supporting the filter 184.

The filter 184 is in the form of a sock filter which extends about the spokes 188 and the fins 190 of the filter body 182. The upper end of the filter 184 comprises a collar 194, which is retained within an annular groove formed in the filter body 182. The lower end of the filter 184 comprises a base or end cap 196 for closing the lower end of the filter 184 for ease of insertion of the filter assembly 180 into the filter housing 154.

The filter 184 further comprises a plurality of tubular filter members of varying levels of filtration for removing dust and other particulates from the fluid flow passing through the filter housing 154. The filter member having the finest level of filtration is preferably has the largest surface area. Each filter member of the filter assembly 180 is manufactured with a rectangular or tapering shape. The filter members are then joined and secured together along their longest edge by stitching, gluing or other suitable technique so as to form a tubular length of filter material having a substantially open cylindrical shape. An upper end of each cylindrical filter member is then attached to the collar 194, while a lower end of each filter member is attached to the end cap 196, for example by overmolding the material of the collar 194 and the end cap 196 during manufacture of the filter assembly 180. Alternative manufacturing techniques for attaching the filter members include gluing, and spin-casting polyurethane around the upper and lower ends of the filter members. In this way the filter members are encapsulated by polyurethane during the manufacturing process to produce a sealed arrangement which is capable of withstanding manipulation and handling by a user.

The filter body 182 comprises an annular sealing member 198 for engaging the air inlet 200 of the outlet duct 30. With reference to FIGS. 1 and 2(*a*), in this example the air inlet 200 of the outlet duct 30 is generally dome-shaped, and enters the filter assembly 180 through the open upper end 202 of the filter body 182 to engage the sealing member 198 and form an air-tight seal therewith. The sealing member 198 may be overmolded with the filter body 182 during assembly, or otherwise attached to the filter body 182. Alternatively, the sealing member 198 may be integral with the filter body 182.

The outlet duct 30 is generally in the form of a curved arm extending between the separating apparatus 12 and the rolling assembly 20. The outlet duct 30 is moveable relative to the separating apparatus 12 to allow the separating apparatus 12 to be removed from the vacuum cleaner 10, and to allow the filter assembly 180 to be removed from the filter housing 154 of the separating apparatus 12. The end of the tube outlet duct 30 which is remote from the air inlet 200 of the outlet duct 30 is pivotably connected to the main body 22 of the rolling assembly 20 to enable the outlet duct 30 to be moved between a lowered position in which the outlet duct 30 is in fluid communication with the separating apparatus 12, and a raised position which allows the separating apparatus 12 to be removed from the vacuum cleaner 10.

The outlet duct 30 is biased towards the raised position by a resilient member (not shown) located in the main body 22. The main body 22 comprises a biased catch 204 for retaining the outlet duct 30 in the lowered position against the force of the resilient member, and a catch release button 206. The outlet duct 30 comprises a handle 208 to allow the vacuum cleaner 10 to be carried by the user when the outlet duct 30 is retained in its lowered position. Alternatively, the outlet duct 30 may be used to carry the vacuum cleaner 10. The catch 204 is arranged to co-operate with a finger 210 connected to outlet duct 30 to retain the outlet duct in its lowered position. Depression of the catch release button 206 causes the catch 204 to move away from the finger 210, against the biasing force applied to the catch 204, allowing the resilient member to move the outlet duct 30 to its raised position.

The rolling assembly 20 will now be described with reference to FIGS. 6(*a*) and 8. The rolling assembly 20 comprises a main body 22 and two curved wheels 24, 26 rotatably connected to the main body 22 for engaging a floor surface. In this embodiment the main body 22 and the wheels 24, 26 define a substantially spherical rolling assembly 20. In this example, the main body 20 comprises an upper section 212 and a lower section 214 connected to the upper section 212. The support 106 is integral with the upper section 212, whereas the chassis 32 is integral with the lower section 214. The wheel 24 is mounted on an axle 216 connected to the lower section 214 of the body 22, whereas the wheel 26 is mounted on an axle 218 connected to the upper section 212 of the body 22. The axles 216, 218 are arranged so that the rotational axes of the wheels 24, 26 are inclined upwardly towards the main body 22 with respect to a floor surface upon which the vacuum cleaner 10 is located so that the rims of the wheels 24, 26 engage the floor surface. The angle of the inclination of the rotational axes of the wheels 24, 26 is preferably in the range from 4 to 15°, more preferably in the range from 5 to 10° to minimize point contact with a floor surface.

Figure 8:
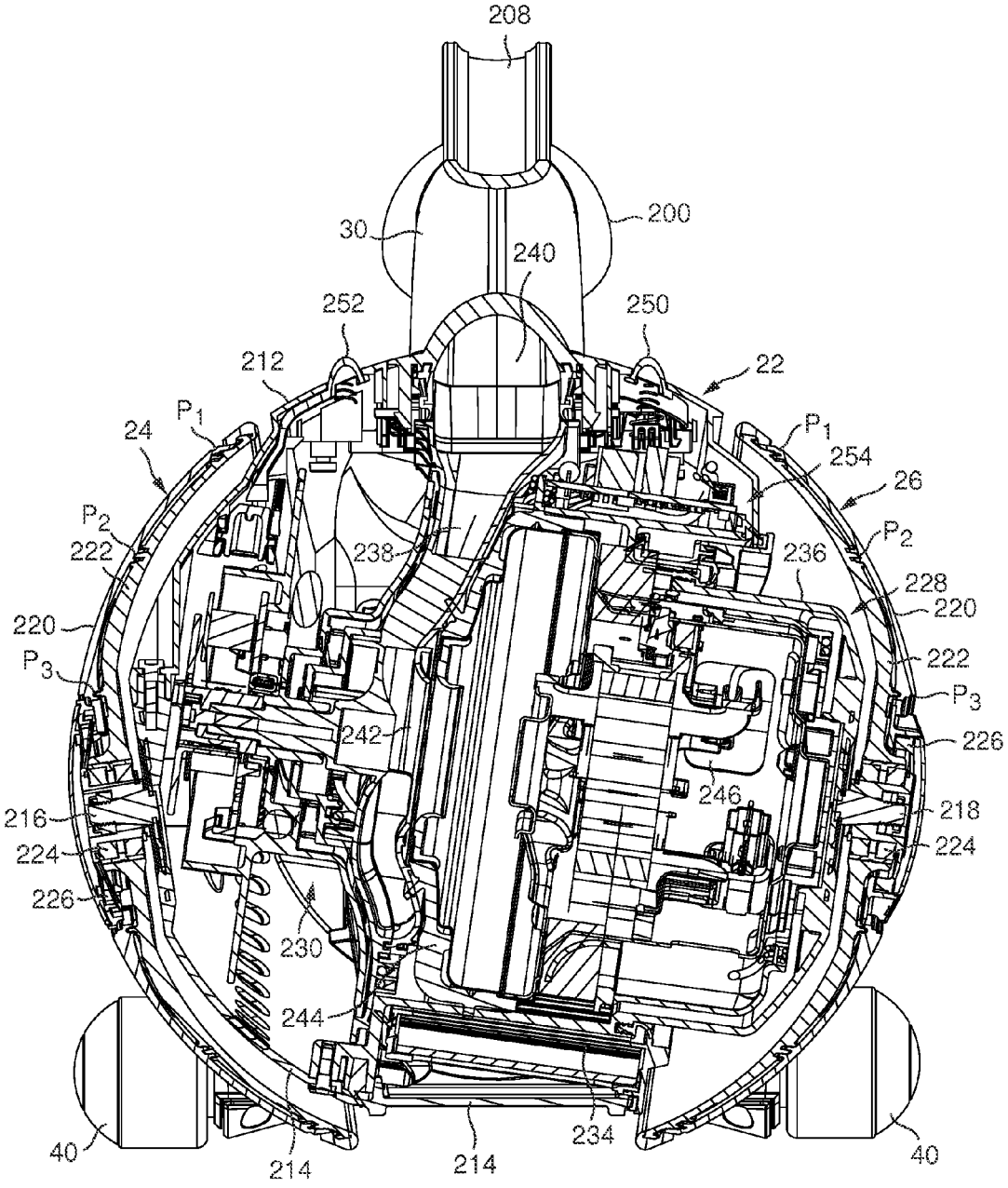
FIG. 8 is a rear sectional view taken along line B-B in FIG. 2(*c*).

Each of the wheels 24, 26 of the rolling assembly 20 is generally dome-shaped. Each wheel 24, 26 comprises an outer wheel member 220 and an inner wheel member 222 connected to the outer member 220 about the periphery thereof. The outer wheel member 220 and the inner wheel member 222 are preferably connected together using a spin welding technique. A plurality of annular connections is preferably made between the wheel members 220, 222. In this example, the wheel members 220, 222 are joined together at three different positions $P_1$, $P_2$ and $P_3$, each of which is illustrated in FIG. 8. Position $P_1$ is located at or towards the outer rims of the wheel members 220, 222, position $P_3$ is located at or towards the center of the wheel members 220, 222, and position $P_2$ is located generally midway between positions $P_1$ and $P_3$. The inner surface of the outer wheel member 220 and the outer surface of the inner wheel member 222 comprise interengaging features located at each of these positions. For example, one of the wheel members 220, 222 may comprises a series of circular grooves each for received a respective raised circular bands formed on the other wheel member 220, 222

The wheel members 220, 222 are formed from a relatively stiff material, preferably from a plastics material. For example, each of the wheels members 220, 222 is preferably formed from a glass-filled polypropylene, preferably a 30% glass-filled polypropylene. Alternatively, the wheels members 220, 222 may be formed from different plastics material. For example, the outer wheel member 220 may be formed from a 20% glass-filled polypropylene.

The inner wheel member 222 is shaped so as to maintain the outer wheel member 220 in a state of tension. This can make the outer surface of the wheels 24, 26 relatively stiff, thereby making the wheels 24, 26 less prone to deformation, for example due to impact with objects during a cleaning process.

The inner wheel member 222 comprises an annular bearing arrangement 224 for rotatably supporting the wheel 24, 26 on its axle 216, 218. During assembly, the wheels 24, 26 are located over their respective axles 216, 218, and a fastener 226 is connected over the bearing arrangement 224 to retain the wheel 24, 26 on its axle 216, 218.

The rolling assembly 20 houses a motor-driven fan unit 228, a cable rewind assembly 230 for retracting and storing within the main body 22 a portion of an electrical cable (not shown) terminating in a plug 232 providing electrical power to, inter alia, the motor of the fan unit 228, and at least one filter assembly 234. The fan unit 228 comprises a motor, and an impeller driven by the motor to drawn the dirt-bearing fluid flow into and through the vacuum cleaner 10. The fan unit 228 is housed in a motor bucket 236. The motor bucket 236 is connected to the lower section 214 of the main body 22 so that the fan unit 228 does not rotate as the vacuum cleaner 10 is maneuvered over a floor surface. In this example, the filter assembly 234 is located downstream of the fan unit 228. The filter assembly 234 is cuff shaped and located around a part of the motor bucket 236. A plurality of perforations is formed in a portion of the motor bucket 236 which is surrounded by the filter assembly 234 to allow air to pass from the motor bucker 236 to the filter assembly 234.

The filter assembly 234 may be periodically removed from the rolling assembly 20 to allow the filter assembly 234 to be cleaned. The filter assembly 234 is accessed by removing the wheel 26 of the rolling assembly 20. This wheel 26 may be removed, for example, by the user first removing the fastener 226, and then pulling the wheel 26 from the axle 218. The filter assembly 234 may then be removed from the rolling assembly 20 by depressing a catch connecting the filter assembly 234 to the motor bucket 236, and pulling the filter assembly 234 from the rolling assembly 20.

The main body 22 of the rolling assembly 20 further comprises a motor inlet duct 238 for conveying a fluid flow received from the outlet duct 30 to the motor bucket 236. The motor inlet duct 238 is connected to the upper section 212 of the body 22 of the rolling assembly 20, and has a fluid inlet 240 and a fluid outlet 242. The cable rewind assembly 230 is mounted on the side of the motor inlet duct 238 which is opposite to the fluid outlet 242. An annular seal 244 may be provided between the motor bucket 236 and the motor inlet duct 238. The fan unit 228 comprises a series of exhaust ducts 246 located around the outer circumference of the fan unit 228. In the preferred embodiment a plurality of exhaust apertures 246 are arranged around the fan unit 228 and provide communication between the fan unit 228 and the motor bucket 236.

The main body 22 further comprises an air exhaust port for exhausting cleaned air from the vacuum cleaner 10. The exhaust port is formed towards the rear of the main body 22. In the preferred embodiment the exhaust port comprises a number of orifices 248 located in a lower section 214 of the main body 22, and which are located so as to present minimum environmental turbulence outside of the vacuum cleaner 10.

A first user-operable switch 250 is provided on the main body and is arranged so that, when it is depressed, the fan unit 228 is energized. The fan unit 228 may also be de-energized by depressing this first switch 250. A second user-operable switch 252 is provided adjacent the first switch 250. The second switch 252 enables a user to activate the cable rewind assembly 230. Circuitry 254 for driving the fan unit 228, cable rewind assembly 230 and other auxiliary components of the vacuum cleaner 10 is also housed within the rolling assembly 20.

In use, the fan unit 228 is activated by the user pressing the switch 250, and a dirt-bearing fluid flow is drawn into the vacuum cleaner 10 through the suction opening in the cleaner head. The dirt-bearing air passes through the hose and wand assembly, and enters the inlet duct 28. The dirt-bearing air passes through the inlet duct 28 and enters the dirty air inlet 108 of the separating apparatus 12. Due to the tangential arrangement of the dirty air inlet 108, the fluid flow follows a helical path relative to the outer wall 16. Larger dirt and dust particles are deposited by cyclonic action in the annular chamber 130 and collected therein.

The partially-cleaned fluid flow exits the annular chamber 130 via the apertures in the shroud and enters the plenum chamber 158. From there, the fluid flow enters the twelve cyclones 146, wherein further cyclonic separation removes some of the dirt and dust still entrained within the fluid flow. This dirt and dust is deposited in the dust collector 122 while the cleaned air exits the cyclones 146 via the vortex finders 164 and enters the manifold fingers 166. The fluid flow then passes into the filter housing 154 through the apertures 170. Within the filter housing 154, the air flow flows through the filter 184 of the filter assembly 180. The support provided by the spokes 188 and fins 190 of the filter body 182 prevents the filter 184 from collapsing as the air flow passes through the filter 184. The air flow subsequently passes axially through the filter body 182 to be exhausted through the air outlet 202 of the filter assembly 180 and into the dome-shaped air inlet 200 of the outlet duct 30.

The air flow passes through the outlet duct 30, and enters the main body 22 of the rolling assembly 20 through the fluid inlet 240 of the motor inlet duct 238. The motor inlet duct 238 guides the fluid flow into the fan unit 228. The fluid flow is subsequently exhausted through the exhaust apertures 246 in the side of the fan unit 228 and into the motor bucket 236. The fluid flow leaves the motor bucket 236 through the perforations and passes through the filter assembly 234. Finally the fluid flow follows the curvature of the main body 22 to the orifices 248 in the main body 22, from which the cleaned fluid flow is ejected from the vacuum cleaner 10.

Through use, the filter assembly 180 can become clogged, causing a reduction in the filtration efficiency, and so the filter assembly 180 will require periodic cleaning or replacement. In the preferred embodiment the filter assembly 180 is capable of being cleaned by washing. The filter assembly 180 can be accessed by the user for cleaning when the outlet duct 30 is in its raised position. The user removes the filter assembly 180 from the separating apparatus 12 by gripping one of the spokes 188 of the filter body 182, and pulling the filter assembly 180 from the filter housing 154. The filter assembly 180 can be washed by rinsing under a household tap and allowed to dry. The filter assembly 180 is then re-inserted into the filter housing 154 of the separating apparatus 12, the outlet duct 30 is moved to its lowered position and use of the vacuum cleaner 10 can continue.

When the outlet duct 30 is in its raised position, the separating apparatus 12 may be removed from the vacuum cleaner 10 for emptying and cleaning. The separating apparatus 12 comprises a handle 250 for facilitating the removal of the separating apparatus 12 from the vacuum cleaner 10. The handle 250 is connected to the upper section 160 of the exhaust manifold 122, for example by a screw or a snap-fit connection. To empty the separating apparatus 12, the user depresses a button 252 located on the upper section 160 of the exhaust manifold for actuating a mechanism for applying a downward pressure to the uppermost portion of the catch on the base 18. This causes the catch to deform and disengage from the groove located on the outer wall 16 of the outer bin 14. This enables the base 18 to move away from the outer wall 16 to allow dirt and dust that has been collected in the separating apparatus 12 to be emptied into a dustbin or other receptacle. The mechanism for applying the force to the catch preferably comprises a series of push rods which are moved towards the catch in response to the depression of the button 252. The arrangement of push rods allows the outer bin 14 to be separated from the cyclone pack 140.

The invention claimed is:

1. A cleaning appliance comprising a substantially spherical surface engaging rolling assembly comprising a fluid inlet for receiving a fluid flow and a system for drawing the fluid flow through the inlet, and a plurality of support members for supporting the rolling assembly as it is maneuvered over a surface, wherein the center of gravity of the cleaning appliance is located within the rolling assembly, wherein the rolling assembly comprises a main body and a plurality of floor engaging rolling elements rotatably connected to the main body, wherein the main body has a front surface, and wherein when the cleaning appliance is located on a substantially horizontal surface, the center of gravity of the cleaning appliance is located in a first vertical plane which is located between a second vertical plane containing the point of contact between the rolling assembly and the surface, and a third vertical plane containing the points of contact between the support members and the surface.

2. The appliance of claim 1, wherein the center of gravity is located substantially midway between the second and third planes.

3. The appliance of claim 1, wherein said system for drawing the fluid flow through the inlet is connected to the main body.

4. The appliance of claim 1, wherein the rotational axes of the rolling elements are inclined upwardly towards the main body with respect to a surface upon which the cleaning appliance is located.

5. The appliance of claim 1, wherein each of the plurality of rolling elements has a substantially spherical curvature.

6. The appliance of claim 1, wherein the distance between the points of contacts of the rolling elements of the rolling assembly with the surface is shorter that the distance between the points of contacts of the support members with the surface.

7. The appliance of claim 1, wherein the distance between the points of contact of the support members with the surface is at least 1.5 times the distance between the points of contacts of the rolling elements of the rolling assembly with the surface.

8. The appliance of claim 1, wherein each support member comprises a wheel.

9. The appliance of claim 1, wherein the system for drawing a fluid flow into the rolling assembly comprises a motor driven fan unit.

10. The appliance of claim 1, wherein the rolling assembly comprises a filter for removing particulates from the fluid flow.

11. The appliance of claim 1, comprising cyclonic separating apparatus for separating dirt from the fluid flow.

12. The appliance of claim 11, wherein the separating apparatus is located outside the rolling assembly.

13. The appliance of claim 1, wherein said plurality of support members is mounted on a chassis connected to the rolling assembly.

14. The appliance of claim 13, wherein the chassis comprises a body connected to the rolling assembly and a plurality of side portions, and wherein each support member is connected to a respective side portion of the chassis.

15. The appliance of claim 14, wherein each support member is located behind its respective side portion.

16. The appliance of claim 14, wherein each side portion has an inclined front surface.

* * * * *